US006237575B1

(12) United States Patent
Lampert et al.

(10) Patent No.: US 6,237,575 B1
(45) Date of Patent: May 29, 2001

(54) DYNAMIC INFRARED SENSOR FOR AUTOMOTIVE PRE-VAPORIZED FUELING CONTROL

(75) Inventors: Jordan K. Lampert, Metuchen, NJ (US); Andrian I. Kouznetsov, Santa Barbara; Jacob Y. Wong, Goleta, both of CA (US); Ronald M. Heck, Frenchtown; John J. Steger, Pittstown, both of NJ (US); Arthur Bruce Robertson, Greenbelt, MD (US); Jeff H. Moser, White Lake, MI (US)

(73) Assignee: Engelhard Corporation, Iselin, NJ (US)

( * ) Notice: Subject to any disclaimer, the term of this patent is extended or adjusted under 35 U.S.C. 154(b) by 0 days.

(21) Appl. No.: 09/288,243

(22) Filed: Apr. 8, 1999

(51) Int. Cl.[7] ..... F02M 25/08
(52) U.S. Cl. ..... 123/520; 123/704; 123/516
(58) Field of Search ..... 123/704, 698, 123/516, 518, 519, 520; 250/343, 339, 341; 73/23.2, 23.31, 31.05

(56) References Cited

U.S. PATENT DOCUMENTS 3,741,006 * 6/1973 Bordeaux ..... 73/118.1
3,741,007 * 6/1973 Bordeaux ..... 73/118.1

(List continued on next page.)

OTHER PUBLICATIONS

SAE Paper No. 961957, by Edward W. Kaiser, Walter O. Siegl, Gerald P. Lawson, Frank T. Connolly, Carl F. Cramer, Kelvin L. Dobbins, Paul W. Roth, and Michael Smokovitz, Ford Motor Co., dated Oct. 14–17, 1996, entitled "Effect of Fuel Preparation on Cold–Start Hydrocarbon Emissions from a Spark–Ignited Engine".

SAE Paper No. 930710, by R. J. Boyle amd D. J. Boam, National Engineering Lab. and I. C. Finlay, Thermal Systems Research, dated Mar. 1–5, 1993, entitled "Cold Start Performance of an Automotive Engine Using Prevaporized Gasoline".

SAE Paper No. 860246, by Charles Aquino and William D. Plensdorf, Ford Motor Co., dated Feb. 24–28, 1986, entitled "An Evaluation of Local Heating as a Means of Fuel Evaporation for Gasoline Engines".

*Primary Examiner*—Henry C. Yuen
*Assistant Examiner*—Hieu T. Vo
(74) *Attorney, Agent, or Firm*—Richard A. Negin

(57) ABSTRACT

A pre-vaporized fuel system for use in fueling an internal combustion engine is provided with a dynamic infrared sensor. The infrared sensor senses the hydrocarbon content of the vaporized fuel which information is used by the engine control module to control engine fueling to minimize emissions. The infrared source is operated to maintain the pre-vaporized fuel below its lower explosive limit and the thermopile detector electronics is synchronized with the light pulse frequency to develop fast signal responses suitable for fueling control.

28 Claims, 12 Drawing Sheets

U.S. PATENT DOCUMENTS

| | | | | |
|---|---|---|---|---|
| 4,003,358 | | 1/1977 | Tatsutomi et al. . | |
| 4,323,777 | | 4/1982 | Baskins et al. . | |
| 4,541,272 | | 9/1985 | Bause | 73/118 |
| 4,578,762 | | 3/1986 | Wong . | |
| 4,694,173 | | 9/1987 | Wong . | |
| 4,709,150 | | 11/1987 | Burough et al. | 250/338 |
| 4,945,885 | | 8/1990 | Gonze et al. . | |
| 5,111,796 | | 5/1992 | Ogita . | |
| 5,126,570 | * | 6/1992 | Boos | 250/343 |
| 5,225,679 | | 7/1993 | Clarke et al. . | |
| 5,231,969 | | 8/1993 | Suga . | |
| 5,262,645 | | 11/1993 | Lambert et al. . | |
| 5,275,144 | | 1/1994 | Gross . | |
| 5,294,796 | * | 3/1994 | Fee | 250/338.5 |
| 5,390,644 | * | 2/1995 | Nunogaki et al. | 123/520 |
| 5,401,967 | | 3/1995 | Stedman et al. . | |
| 5,464,983 | | 11/1995 | Wang . | |
| 5,482,023 | | 1/1996 | Hunt et al. . | |
| 5,529,035 | | 6/1996 | Hunt et al. . | |
| 5,608,219 | | 3/1997 | Aucremanne . | |
| 5,644,069 | * | 7/1997 | Liu et al. | 73/23.2 |
| 5,647,332 | | 7/1997 | Hyodo et al. . | |
| 5,694,906 | | 12/1997 | Lange et al. . | |
| 5,709,082 | | 1/1998 | Harris et al. | 60/276 |
| 5,782,275 | | 7/1998 | Hartsell, Jr. et al. . | |
| 5,806,500 | | 9/1998 | Fargo et al. . | |
| 5,816,223 | | 10/1998 | Jamrog et al. . | |
| 5,823,171 | | 10/1998 | Farmer et al. | 123/704 |
| 5,850,821 | | 12/1998 | Curtis . | |
| 5,850,822 | | 12/1998 | Romann et al. . | |
| 5,992,395 | * | 11/1999 | Hartsell, Jr. et al. | 123/516 |

* cited by examiner

DYNAMIC INFRARED SENSOR FOR AUTOMOTIVE PRE-VAPORIZED FUELING CONTROL

This invention relates generally to infrared (IR) sensors and more particularly, to automotive pre-vaporized systems utilizing IR sensors for fueling control.

The invention is particularly applicable to and will be described with specific reference to fuel system controls for internal combustion engines using detergent grade gasoline. However, those skilled in the art will readily understand that the invention is applicable to other types of fuel such as diesel fuel and is specifically suited for fueling control of vehicles using multi-fuel systems such as those containing gasoline and alcohol (i.e., ethanol) as well as detergent grade gasolines.

INCORPORATION BY REFERENCE

The following United States patents and articles are incorporated by reference herein and made a part hereof so that details of IR sensors and fueling systems known to those skilled in the art need not be restated herein in detail. None of the patents or articles incorporated herein by reference form any part of the present invention.

- U.S. Pat. No. 5,850,821, issued Dec. 22, 1998 to Curtis, entitled "Method and System for Estimating Air/Fuel Ratio of an Engine Having a Non-Heated Fuel Vaporizer";
- U.S. Pat. No. 5,782,275, issued Jul. 21, 1998 to Hartsell, Jr. et al., entitled "Onboard Vapor Recovery Detection";
- U.S. Pat. No. 5,694,906, issued Dec. 9, 1997 to Lange et al., entitled "Fuel Injection System for a Combustion Engine";
- U.S. Pat. No. 5,608,219, issued Mar. 4, 1997 to Aucremanne, entitled "Device for Detecting Gas by Infrared Absorption";
- U.S. Pat. No. 5,529,035, issued Jun. 25, 1996 to Hunt et al., entitled "Cold Start Fuel Injector with Heater";
- U.S. Pat. No. 5,464,983, issued Nov. 7, 1995 to Wang, entitled "Method and Apparatus for determining the concentration of a gas";
- U.S. Pat. No. 5,262,645, issued Nov. 16, 1993 to Lambert et al., entitled "Sensor for Measuring Alcohol Content of Alcohol Gasoline Fuel Mixtures";
- U.S. Pat. No. 5,225,679, issued Jul. 6, 1993 to Clarke et al., entitled "Methods and Apparatus for Determining Hydrocarbon fuel Properties";
- U.S. Pat. No. 4,323,777, issued Apr. 6, 1982 to Baskins et al., entitled "Hydrocarbon Gas Analyzer";
- SAE Paper No. 961957, dated Oct. 14–17, 1996, entitled "Effect of Fuel Preparation on Cold-Start Hydrocarbon Emissions from a Spark-Ignited Engine";
- SAE Paper No. 930710, dated Mar. 1–5, 1993, entitled "Cold Start Performance of an Automotive Engine Using Prevaporized Gasoline"; and
- SAE Paper No. 860246, dated Feb. 24–28, 1986, entitled "An Evaluation of Local Heating as a Means of Fuel Evaporation for Gasoline Engines".

BACKGROUND

A) Evaporative Emission Systems.

Emission regulations prevent release of gasoline vapors to the atmosphere. To meet such regulations, vehicles are equipped with closed evaporative emission control systems which trap vapors that evaporate from the gasoline in the fuel tank in evaporative canisters containing fuel vapor absorbing substances such as charcoal. Emission regulations currently require that the evaporative canisters and the evaporative emission control system pass not only a pressure maintenance test but also a purge flow test which uses engine vacuum to draw fuel vapors from the tank and those stored in the evaporative canister into the engine for combustion.

It has long been known that emitting fuel vapors from the evaporative canisters into the intake manifold adversely affects the air/fuel ratio present in the combustion chambers of the internal combustion engine. The rich mixture produces excessive emissions and adversely affects driveability and/or engine operation. Accordingly, adjustments to the air/fuel mixture, such as disclosed in U.S. Pat. No. 4,003,358 to Tatsutomi et al., issued Jan. 18, 1977, have been made to account for the fuel vapors admitted to the engine from the evaporative canisters. Not surprisingly, as emission regulations have become more stringent, the controls regulating the flow of the fuel vapors to the engine have become more sophisticated. Thus, in U.S. Pat. No. 5,647,332 to Hyodo et al., issued Jul. 15, 1997, the engine control unit judges the operating condition of the vehicle and controls the opening of an atmospheric cannister control valve to control the mass flow of the vapors emitted from the canisters in accordance with the operating condition of the engine. See also U.S. Pat. No. 5,806,500 to Fargo et al., issued Sep. 15, 1998 in which a plurality of canisters connected in series with a by-pass air purge actuated by the engine control module also controls the fuel delivery to the fuel injectors to insure driveability and emission compliance. See also U.S. Pat. No. 5,816,223 to Rummage et al., issued Feb. 16, 1993, which uses pressure transducers and time rate of change to monitor air/vapor flow to the intake manifold vis-a-vis look-up tables and the like to assure combustion stability and prevent engine roughness or stalling.

In general summary, evaporative canister systems use a pressure regulated air purge to control admission of fuel vapors to the engine through any number of control techniques to maintain the air/fuel ratio at or near stoichiometric during normal engine operation. However, the prior art systems cannot account for the change in hydrocarbon concentration of the fuel vapors such as the change in concentration which occurs when and as the fuel vapors are being exhausted from the canisters. While current evaporative control techniques may be acceptable with engines using standard grades of gasoline and current emission standards, conventional systems may not be acceptable under stricter emission regulations which may be proposed in the future and which will require more accurate fueling control. The prior art does recognize that existing evaporative control system techniques are not acceptable when different types of fuel are used in the vehicle. See, for example, evaporative system control changes should the vehicle be subject to fuels containing alcohol as set forth in U.S. Pat. Nos. 4,945,885 to Gonze et al., issued Aug. 7, 1990; 5,111,796 to Ogita, issued May 12, 1992; and, 5,231,969 to Suga, issued Aug. 3, 1993.

B) Cold-Start.

Proposed emission standards require that a regulated drive cycle such as an FTP (Federal Test Procedure) or its European equivalent (an MVG), include a "cold-start" requirement. "Cold-start" conventionally means a condition where the engine and catalytic converter are at temperatures not greater than about 50° C. at the time the engine is started. When the engine is started from a cold condition, the catalytic converter is not catalytically active. In fact, a substantial amount of the emissions produced by the vehicle over a regulated drive cycle are attributed to the emissions produced at cold-start and during engine warm-up following a cold-start. (Warm-up of the engine occurs when the catalytic converter becomes substantially catalytically active, i.e., a condition conventionally defined to mean that 50% of the combustible emissions (CO, HC, $H_2$, $NO_x$) are converted by the catalytic converter to $N_2$, $CO_2$ and $H_2$ and often times is referred to as "light-off" of the catalytic converter.) Further, emission sensors, typically EGO (exhaust gas oxygen) sensors, cannot provide a feedback signal at cold-start so the fueling control is open loop and not closed loop.

Emission control at cold-start and during warm-up has generated a separate body of prior art directed to resolving this problem such as the development of light-off catalysts, $NO_x$ traps, etc.

Most significant, however, is the fact that it is well understood in the prior art that pre-vaporization of the fuel materially reduces the presence of regulated emissions emitted by the engine during cold-start and warm-up. This can be documented from any number of sources such as SAE papers No. 860246, dated Feb. 24–28, 1986, entitled "*An Evaluation of Local Heating as a Means of Fuel Evaporation For Gasoline Engines*"; 930710, dated Mar. 1–5, 1993, entitled "*Cold Start Performance of an Automotive Engine Using Prevaporized Gasoline*"; and 961957, dated Oct. 14–17, 1996, entitled "*Effect of Fuel Preparation on Cold-Start Hydrocarbon Emissions from a Spark-Ignited Engine*", all of which are hereby incorporated herein by reference.

The prior art has adopted a number of arrangements utilizing pre-vaporized fuel for reducing emissions produced during cold-start and warm-up of an internal combustion engine. In U.S. Pat. No. 5,529,035 to Hunt et al., issued Jun. 25, 1996, a heated cold-start fuel injector introduces vaporized fuel to the fuel rail of the engine. In U.S. Pat. No. 5,694,906 to Lange et al., issued Dec. 9, 1997, an unheated fuel vaporizer injector is used for cold-start which converts to regular fuel injection operation when the engine reaches normal operating conditions. In U.S. Pat. No. 5,482,023 to Hunt et al., issued Jan. 9, 1996, a heated cold-start injector along with fuel vapors from the evaporator canister are used for cold-start. In U.S. Pat. No. 5,850,822 to Romann et al., issued Dec. 22, 1998, two fuel injector valves are utilized with the cold-start heated injector fueling the engine through one intake valve during cold-start and warmup phases, and the conventional injector fueling the engine through the "normal" intake valve at normal operating engine temperatures. In U.S. Pat. No. 5,850,821 to Curtis, issued Dec. 22, 1998, a non-heated cold-start injector is utilized and the observation is made that it is not known what vaporization is achieved. Curtis then measures the temperature or calculates the temperature to determine an estimated fuel vaporization. All of these systems assume that a fuel vaporization level is achieved at a given temperature and that the vaporization will, in turn, achieve certain expected results when the vapors are combusted in the combustion chamber of the engine. More particularly, given the relatively narrow composition range of detergent grade gasoline, a fuel vaporizer will produce known hydrocarbon gas compositions at elevated temperature such that timing and air to fuel ratios can be set to assure desired combustion. However, different fuels can be used and even detergent grade gasolines have different octane ratings. What is actually needed, or will be needed to meet future emission regulations, is a direct measurement of the gas phase fuel concentration or air to fuel ratio of the mixture ported to the combustion chambers of the engine.

C) Infrared Sensors.

Infrared sensors can measure hydrocarbon concentrations in a gas but if the hydrocarbon concentration produces an explosive mixture, the infrared sensors must be equipped with a flame arrester to prevent auto ignition of the gas from the infrared source. The flame arrester severely limits the sample flow rate of the gas to be measured through the sensor resulting in a slow response time. U.S. Pat. No. 4,323,777 to Baskins et al., issued Apr. 6, 1982 (incorporated herein by reference), illustrates the ability of infrared sensor to detect the presence of hydrocarbon vapors in a gas sample, but at relatively low hydrocarbon level concentrations such that the gas being sensed is not flammable, i.e., at concentrations below the lower explosive limit of the gases being sensed. The Baskins device is primarily concerned with toxicity. More pertinent is U.S. Pat. No. 5,608,219 to Aucremanne, issued Mar. 4, 1997 (incorporated herein by reference), uses a large sized infrared source to maintain the black body temperature below the auto ignition temperature of the gaseous mixture thus obviating the need for a flame arrester or similar devices. However, the sensor response as shown in the graphs of the '219 patent is slow, and is believed too slow to permit use in the fuel controls of an internal combustion engine.

D) Infrared Sensors in the Automotive Field.

In U.S. Pat. No. 5,401,967 to Stedman et al., issued Mar. 28, 1995, an infrared sensor is used to determine the presence and concentration of regulated emissions in the exhaust gas of an internal combustion engine. The emissions in the exhaust gas are not in sufficient concentration to present a flammable or explosive mixture. In U.S. Pat. No. 5,782,275 to Hartsell, Jr. et al., issued Jul. 21, 1998, an infrared sensor is used in a fuel dispensing system (gas station) to determine if the vehicle being fueled is equipped with a vapor recovery system. In U.S. Pat. No. 5,225,679 to Clark et al., issued Jul. 6, 1993, an infrared sensor is used to determine the octane content of gas supplied at the service station pump to a vehicle. Somewhat similar is U.S. Pat. No. 5,262,645 to Lambert et al., issued Nov. 16, 1993, which utilizes an infrared sensor to detect the alcohol content of an alcohol/gasoline mixture used as the fuel for a vehicle. In the latter three references, the black body heat emitted by the infrared source will not exceed the flammability index of the liquid fuel being measured. Clark et al. and Lambert et al. are concerned with measurements of liquids, which while highly flammable, have a higher auto ignition temperature than if the liquid was in a combustible gas/air form.

SUMMARY OF THE INVENTION

Accordingly, it is a principle object of the present invention to provide an infrared sensor for use in pre-vaporized fueling arrangements to permit better engine and emission control than what was otherwise possible.

This object along with other features of the invention is achieved in a vehicular arrangement having an internal combustion engine equipped with a fuel vapor system which uses vapors from the fuel to at least assist in starting the engine during a cold-start. The inventive improvement includes a) an infrared hydrocarbon sensor for sensing the gas phase density or concentration of the vaporized fuel in the fuel-air mixture, b) transducers for measuring the pressure and temperature of the fuel air mixture, and c) an engine control for controlling the air to fuel ratio supplied to the engine based on the sensed air to fuel ratio as determined by the infrared hydrocarbon sensor concentration measurement and the pressure and temperature of the air-fuel mixture whereby the control of the air-to-fuel ratio is significantly advanced over the prior art.

In accordance with another aspect of the invention, the fuel vapor system includes at least one or both items of a group consisting of i) a fuel pre-vaporizer and ii) at least one evaporative canister for storing fuel vapors such that the infrared hydrocarbon sensor permits better engine operation with precise emissions control in systems which a) use only evaporative canisters that must be periodically purged during normal engine operation or during cold-start of the vehicle, b) use pre-vaporized fuel injectors either during cold-start and/or normal operation of the engine, and/or c) use different fuel species such as alcohol based fuels and detergent gasoline or different fuel grades within the same species such as different octane detergent gasolines.

It is yet another feature of the invention to provide an IR hydrocarbon sensor for use in fueling an internal combustion engine in which the infrared sensor has a pulsed radiation source such that the temperature of the gaseous vapor and oxygen passing through the radiation beam generated by the sensor source is not raised beyond the auto-ignition temperature of the gas mixture whereby the pre-vaporized fuel can pass by the sensor unimpeded in its flow and at flow rates required to fuel an internal combustion engine.

In accordance with another aspect of the invention, the IR hydrocarbon sensor has an infrared detector generating an analog signal, proportional to the intensity of IR radiation and a signal conditioning, acquisition and processing electronic circuit to produce sensor signals indicative of the gas phase concentration of the vaporized fuel-air mixture at frequencies required by the engine's control module to effect responsive fueling of the engine.

It is another feature of the invention to provide a method of fueling control using, in whole or in part, vaporized fuel to power the internal combustion engine characterized in that an IR sensor in combination with a pressure and temperature transducer establishes a fuel concentration of the vaporized fuel-air mixture to determine the air to fuel ratio which is used by the engine control module to regulate the engine while controlling the emissions produced by the engine.

In accordance with another specific feature of the invention, the IR sensor signals are used to not only control the engine, such as by its timing, fuel/air ratio, etc. but is also used to control the operation of the fuel vaporizer to generate a pre-vaporized fuel-air mixture to produce whole or in part a specific air to fuel ratio needed to satisfy operator imposed, engine performance conditions while also minimizing regulated emissions produced by the engine especially during engine cold-start and warm-up conditions.

In accordance with another aspect of the invention, a method is provided for controlling the fueling of an internal combustion engine using pre-vaporized fuel. The method includes the steps of a) providing a source for generating or collecting a gas mixture stream having a concentration of pre-vaporized fuel inputted as fuel to the engine; b) passing the stream by a pulsing source of infrared radiation; c) detecting optically filtered radiation transmitted through the gas mixture stream; d) determining the hydrocarbon concentration of the gas mixture from the detected radiation; and e) adjusting the engine operation in response to the detected hydrocarbon concentration in the stream.

In accordance with still another feature of the invention, the hydrocarbon concentration is determined by normalizing each of the detected radiation signals by the hydrogen to carbon atom ratio present in the hydrocarbons of the pre-vaporized fuel whereby the fuel/air content of the mixture is detected for any standard gasoline grade within lambda variations sufficient to control engine operation.

It is thus an object of the invention to provide an infrared hydrocarbon sensor for measuring the concentration or density of fuel vapors so that a precise fuel control strategy can be imposed on an internal combustion engine to limit the emissions produced by the engine, especially during engine cold-start and warm-up.

It is a general object of the invention to provide an IR sensor for use in fuel control strategies for internal combustion engines.

It is another object of the invention to provide an IR sensor for use in pre-vaporized fueling strategies of an internal combustion engine which pulses the infrared source at frequencies such that the temperature of the vaporized fuel does not approach the auto ignition temperature without impeding the fuel vapor flow.

It is yet another object of the invention to provide an IR sensor for measuring the concentration or density of pre-vaporized fuel/air mixtures which generates fast, responsive signals suitable for use in fueling strategies employed by internal combustion engines.

Still another general object of the invention is to provide an IR sensor for use in pre-vaporized fueling systems for internal combustion engines which results in better control of the emissions produced by the engine than heretofore possible while maintaining the responsiveness of the engine to assure good driveability of the vehicle.

Another specific object of the invention is to provide an IR sensor capable of safely measuring the composition of a moving combustible gas mixture without impeding the flow of the gas stream and at a sampling frequency sufficient to permit fueling control of an internal combustion engine predicated on the IR sensor signal.

In accordance with the immediately preceding object, a still further object of the invention is to provide an IR sensor with a control that pulses the light source of the sensor while the detector is read at frequencies synchronized with the pulsed source to minimize sensor signal noise producing discernible signals at sampling frequencies suitable for engine fueling control.

In accordance with a more specific object of the invention and while any known radiation source and detector may be employed in the IR sensor for fueling control, a LED source and a quantum detector is selected and the sensor operated with detector sampling synchronized with pulsed source frequency to generate accurate absorbance signals at relatively high frequencies.

Yet another object of the invention is to provide a relatively inexpensive IR sensor which is commercially feasible for use in automotive fueling control systems.

These and other objects, features, and advantages of the invention will become apparent to those skilled in the art upon reading and understanding the Detailed Description of the Invention set forth below taken in conjunction with the drawings hereof.

BRIEF DESCRIPTION OF THE DRAWINGS

The invention make take form in certain parts and an arrangement of parts taken together and in conjunction with the attached drawings which form a part hereof and wherein.

DETAILED DESCRIPTION OF THE INVENTION

Figure 1:
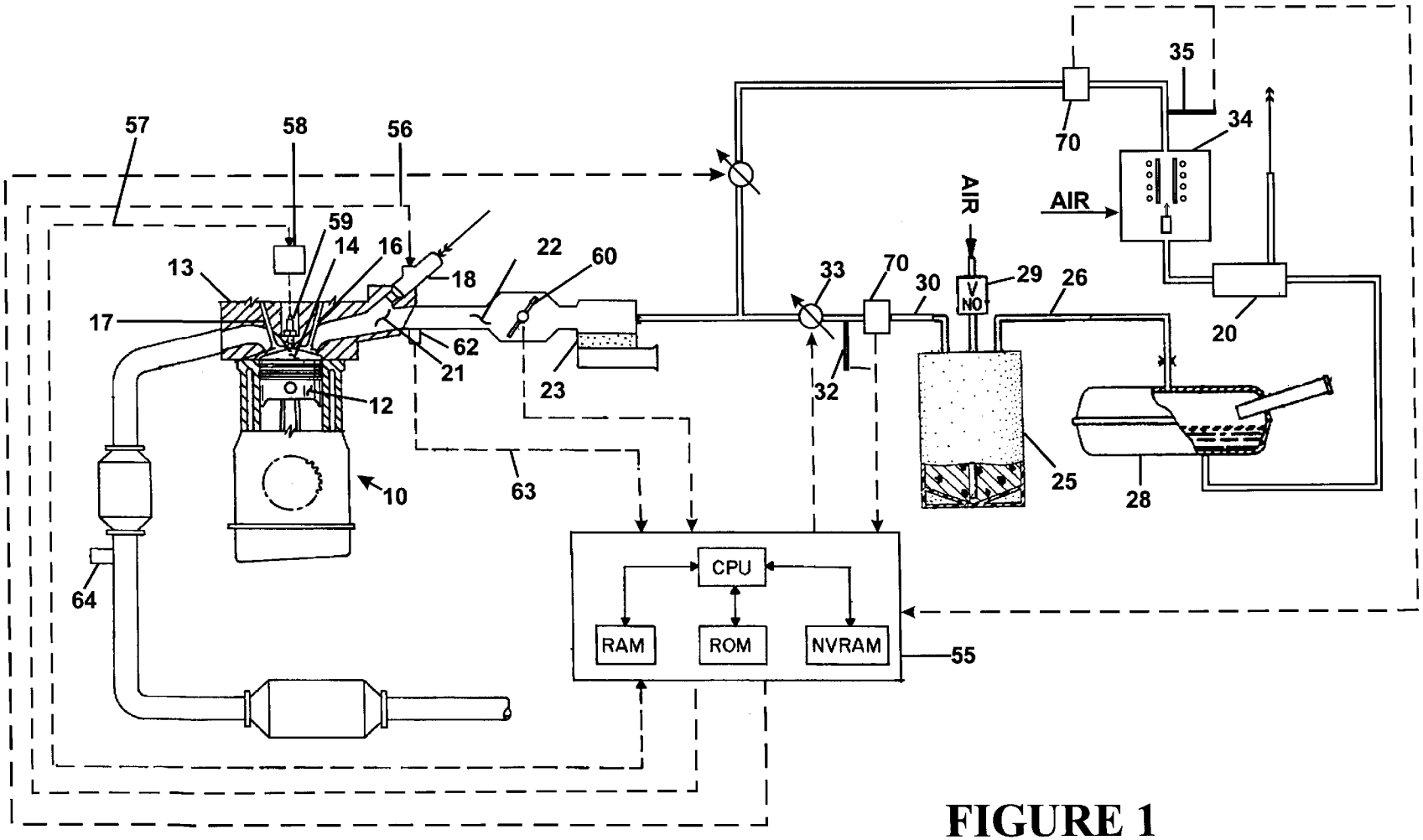
FIG. 1 is a general schematic illustration of various components used in a pre-vaporized fuel system for an internal combustion engine.

Referring now to the drawings wherein the showings are for the purpose of illustrating a preferred embodiment of the invention only and not for limiting the same, there is shown in FIG. 1 a general schematic of a pre-vaporized gasoline arrangement for fueling an internal combustion engine 10. As is well known, internal combustion engine 10 has a number of pistons 12 forming with cylinder head 13 a combustion chamber 14. An intake valve 16 admits a combustible mixture of vaporized fuel and air to combustion chamber 14 and an exhaust valve 17 provides egress of the gaseous products of combustion. Each combustion chamber 14 is provided with a fuel injector 18 which injects fuel into an intake port passage in cylinder head 13. Typically, the fuel supplied by a fuel pump 20 under pressure to injector 18 is emitted as a fine atomized spray into an intake passage 21 formed in cylinder head 13 where, preferably, it is vaporized from engine heat. The fuel is also mixed with air in intake port passage 21 supplied from intake manifold 22 vis-a-vis air filter 23. Within intake port passage 21 there is produced a combustible gaseous mixture which is admitted to combustion chamber 14 upon opening of intake valve 16. This invention is applicable to pre-vaporized fuel systems. As already described, the internal combustion engine supplies vaporized fuel to combustion chamber 14 during normal operation. To avoid confusion in terminology and as a matter of definition, any arrangement which supplies fuel in a gaseous or vaporized form to combustion chamber 14 other than in the conventional manner, as described, is deemed, for purposes of this invention, to be a pre-vaporized fueling arrangement. Thus, if the system provides gaseous or vaporized fuel from an external source into the intake port passage 21 or if fuel injector 18 is modified so that it injects a vaporized or gaseous fuel or partially injects vaporized or gaseous fuel, then the system is deemed to be a pre-vaporized fueling system capable of using the inventive IR hydrocarbon sensor.

In the embodiment illustrated in FIG. 1, the pre-vaporized fuel system includes an evaporative canister 25 connected by a vent line 26 to a fuel tank 28. As noted in the Background, evaporative canister is any conventional storage device which contains a substance, such as activated charcoal, which absorbs fuel vapors. Evaporative canister 25 is fitted with a valved air supply 29 connected to the vehicle's air pump for purging fuel vapors collected in evaporative canister 25 from fuel tank 28. Fuel vapors with purge air are exhausted from evaporative canister 25 through outlet line 30 which is equipped with a first transducer 32 and a metering valve 33 which is in fluid communication with intake manifold 22. First transducer 32 is a pressure transducer and also indicates a temperature sensor should the temperature of the evaporated fuel not be indirectly calculated from other temperature sensors on the vehicle.

The system of FIG. 1 is also equipped with a conventional fuel vaporizer 34 which receives pressurized liquid fuel from fuel pump 20 and air to produce an atomized spray which is gasified. A second transducer 35 in conjunction with a metering valve 36 controls the mass flow rate of pre-vaporized fuel generated by fuel vaporizer 34 to intake manifold 22. Like first transducer 32, second transducer 35 is diagrammatically shown to be a pressure transducer but it is to be understood that probe 35 can additionally represent a temperature sensor in addition to the pressure transducer.

The invention is not limited to a specific design of evaporative canister 25 or fuel vaporizer 34. A somewhat conventional fuel vaporizer is illustrated in FIG. 2.

Figure 2:
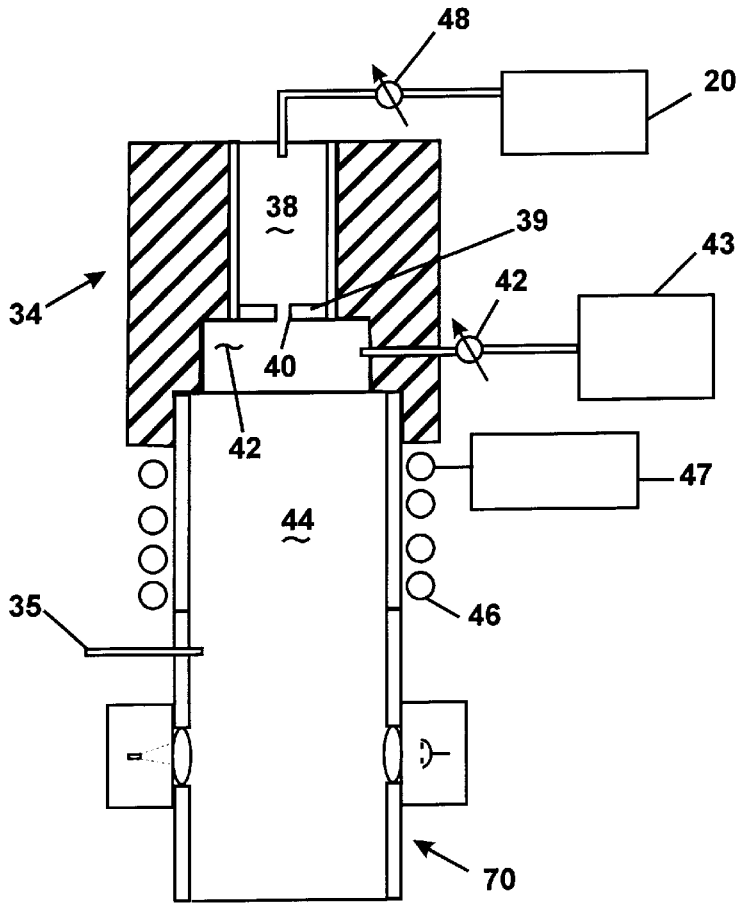
FIG. 2 is a schematic illustration of a pre-vaporized fuel injector equipped with the inventive IR hydrocarbon sensor.

Referring now to FIG. 2, fuel vaporizer 34 is shown as including a central fuel passageway 38 receiving fuel from fuel pump 20 and terminating at an atomizer plate 39 which includes a plurality of orifices 40 arranged in any number of patterns. The fuel as an atomized spray leaves orifices 40 and enters a mixing chamber 42 into which air from a pressurized source such as the vehicle's air pump 43 is injected. The air is injected in any number of ways such as, by way of example, tangentially in mixing chamber 42 thereby creating a tangential swirl of atomized fuel droplets with swirling bands of air which may, for example, force the atomized fuel droplets radially outwardly. The atomized fuel/air mixture passes from mixing chamber 42 to an outlet passage 44. Outlet passage 44 is externally heated, typically by resistance or ceramic heating elements 46 through an appropriate duty cycle imposed by a heater control 47. Outlet passage 44 heats the atomized spray/air mixture into a gaseous or vaporized form. In FIG. 2, a fuel metering valve 48 and an air metering valve 49 is provided, but in practice, the fuel and air ratios are fixed. Utilization of the invention contemplates variable regulation of air and fuel flows to fuel vaporizer 34 as well as metering valve 36. It is to be specifically noted that the term "fuel vaporizer" is not limited to the fuel vaporizer design illustrated in FIG. 2 but, in accordance with the invention, contemplates any conventional fuel vaporizer such as those vaporizers which do not use externally heated arrangements to vaporize the fuel. For example, fuel vaporizers of the type disclosed in U.S. Pat. No. 5,850,821 to Curtis and U.S. Pat. No. 5,694,906 to Lange et al., incorporated herein by reference, may be utilized.

Further, the fueling arrangement illustrated in FIG. 1 is only one of any number of different fueling arrangements possible. For example, an alternative arrangement illustrated in FIG. 3 plumbs fuel vaporizer 34 into a fuel rail 51 fueling fuel injectors 18*a*, 18*b*, 18*c*, 18*d*. A pressure regulator 50 between fuel rail 51 and return rail 52 regulates the pressure of the vaporized fuel in fuel rail 51. After cold-start, when the engine has warmed to the catalytically active temperature, fuel rail 51 receives fuel from fuel pump 20 and operate in a conventional manner. Reference can be had to U.S. Pat. No. 5,529,035 to Hunt et al., incorporated herein by reference, for a further description of such arrangement. Still further, it is conceptually possible for the fuel injectors, as conventionally known, to be replaced by fuel pre-vaporizers when the inventive arrangement such as illustrated in FIG. 2 is used.

Referring again to FIG. 1, the fueling arrangement of internal combustion engine 10 is conventionally under the control of an engine control module or ECM 55. ECM 55 regulates the metering of fuel by signals on line 56 to fuel injector 18. The time and rate at which injector 18 meters the fuel is typically referred to as the injector's pulse width and the quantity of fuel metered during the pulse is typically varied in a manner well known to those skilled in the art and not further defined herein. In addition, ECM 55 controls ignition by signals on ignition line 57 to a spark module 58 controlling sparking of spark plug 59 as well as any valve timing if variable. An air throttle plate 60 controls the air mass inputted to intake port passage 21. Such signals, i.e., timing, injector and air flow will be referred to herein as fueling signals. As is well known, ECM 55 develops fueling signals on the basis of a number of sensor signal inputs indicative of the operating condition of the engine. For example, mass flow sensor 62 develops an input signal on mass flow sensor signal line 63 which ECM 55 uses, in part, to set the desired air/fuel ratio of engine 10. Similarly, an exhaust gas oxygen sensor 64 is also used to establish fueling signals. In fact, a number of sensor signals well known to those skilled in the art and thus not shown in FIG. 1 are used to generate the fueling signals by ECM 55.

When pre-vaporized fuel is added to the fueling system as thus described, adjustments have to be made by ECM 55 to account for the additional presence of fuel vapor in intake port passage 21. While it is possible, in theory, to rely on the emission sensors, i.e., EGO sensor 64, to account for the presence of the pre-vaporized fuel, such control, in practice, is not feasible because of the system delay time. During this delay time, excessive emissions will be produced and in all likelihood, the engine would very well stall because of the incorrect fuel mixture caused by the pre-vaporized fuel. The prior art controls and adjusts for a pre-vaporized fuel by, generally speaking, measuring the mass flow of the purge air or secondary air, the mass flow and/or pressure of the vaporized fuel/air and regulating the flow of the pre-vaporized fuel/air emitted to internal combustion engine 10. See, for example, U.S. Pat. No. 5,806,500 to Fargo et al.; U.S. Pat. No. 5,647,332 to Hyodo et al.; the '023 patent; U.S. Pat. No. 5,275,144 to Gross (all incorporated herein by reference).

Gasolines are well known fuels, generally comprised of a mixture of hydrocarbons and typically composed of mixtures of aromatics, olefins, paraffins. Finished gasoline is typically prepared from a variety of "blending stocks" which are combined to produce a gasoline having a desired octane rating. Further, depending on the vaporization technique employed, it is possible to variably reduce or crack any of the hydrocarbon molecular strings. Further, if the vehicle is subject to different types of fuels such as, for example, gasolines containing added non-hydrocarbons such as alcohol, e.g., ethanol, or oxygenates, e.g., methyl tertiary butyl ether, the air to fuel ratio required to stoichiometrically oxidize the fuel can change.

As noted above, none of the pre-vaporized fueling techniques discussed directly measure the air to fuel ratio of the pre-vaporized fuel/air mixture. The air to fuel ratio is assumed and measurements of air mass and vaporized fuel are then made based on the assumption that the fuel vapor present will be present at a certain defined composition or hydrocarbon make-up which is assumed to encompass all regular grade gasolines. Yet the composition of the vaporized fuel varies within standard grades of gasoline. The composition of the vaporized fuel can vary depending on operation of pre-fuel vaporizer 34. The concentration of hydrocarbons in evaporative canister 25 varies as the canister empties. Eventually, emission regulations will require fueling systems having sufficient responses to account for such variations.

It should be clear that the present day systems would account for the pre-vaporized fuel composition if such systems could do so in an efficient, economical, time responsive manner. For example, laboratory instruments such as flame ionization detectors (FIDs) or other spectroscopy measurement systems do not lend themselves to automotive on-board applications. First, there is the possibility of auto-igniting a highly flammable, gas/air mixture which, as noted above, has a significantly lower auto ignition temperature than that of gasoline in the fuel form. Secondly, for a composition measurement system to be effective as an on-board control, rapid measurements must be taken to provide a responsive system which will adequately function for fueling control of the vehicle. The composition measurement must be with a period of 1 to 2 seconds to be readily assimilated into fueling control routines conventionally used in ECM 55.

Figure 3:
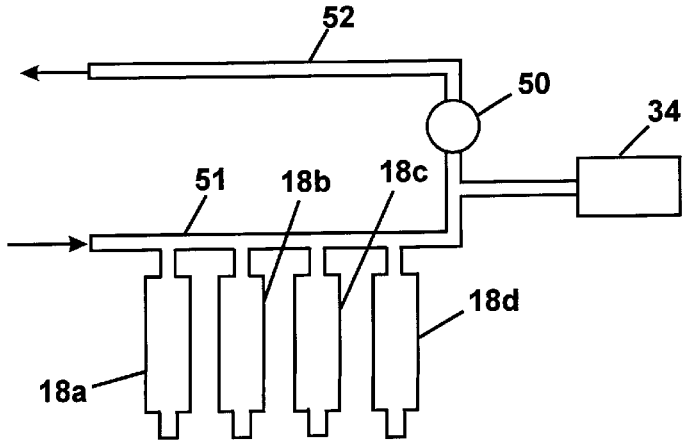
FIG. 3 illustrates schematically an alternative arrangement for using pre-vaporized fuel for an internal combustion engine.
Figure 4:
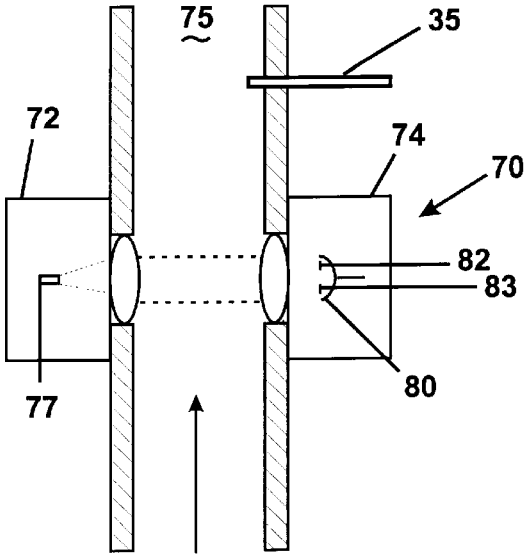
FIG. 4 is a schematic illustration of an IR hydrocarbon sensor used in the invention.
Figure 5:
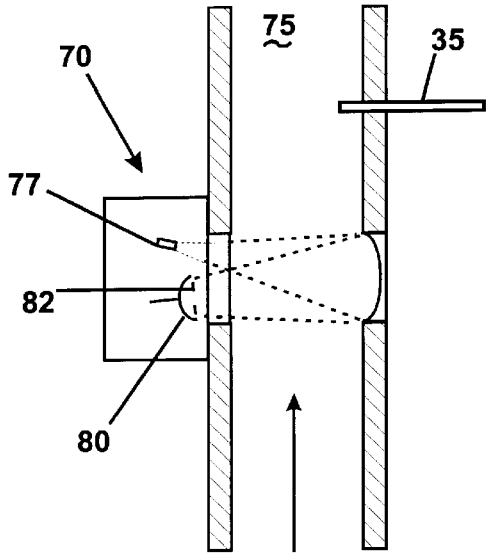
FIGS. 5, 6 and 7 are schematic illustrations of a variation of the IR hydrocarbon sensor illustrated in FIG. 4.
Figure 6:
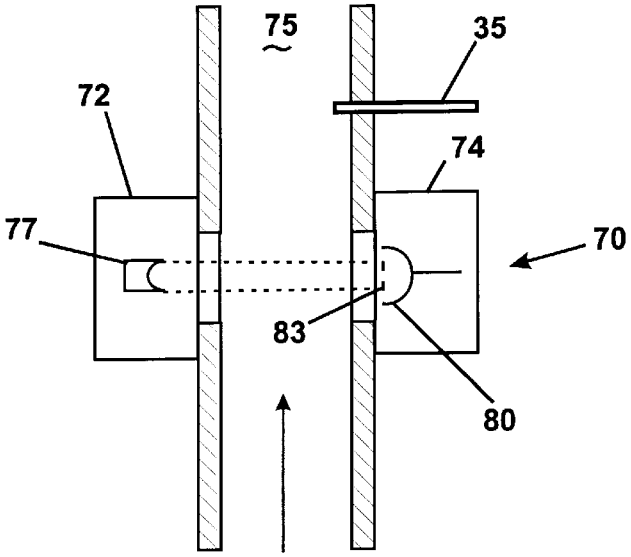

This invention uses an infrared sensor 70 to sense the hydrocarbon concentration in the pre-vaporized fuel generated by the evaporative canister 25 or the fuel vaporizer 34 in systems of the type as discussed with references to FIGS. 1–3.

IR sensor 70 as shown in FIGS. 2, 4, 5, 6 and 7 includes a radiation source chamber with its associated electronics 72 and a detector chamber with its associated electronics 74 with a gas sample chamber 75 between radiation source chamber 72 and detector chamber 74. As is well known, radiation from an infrared light source 77 in radiation source chamber 72 passes through the vaporized fuel-air mixture traveling through gas sample chamber 75 onto a detector 80 in detector chamber 74. Any number of radiation transfer systems can be used to transmit the light from the source, through the gas sample to the detector including, for example, a refractive optical system as diagrammatically shown in FIG. 4, a reflective optical system as diagrammatically shown in FIG. 5, or a focused radiation source system diagrammatically illustrated in FIG. 6. Detector 80 produces an electrical signal that represents the intensity of the radiation falling on it. When using broad band source and broad band detector, in order to make the sensor sensitive to the gases to be measured, it is well known to place a band pass optical filter 82 in the optical path in front of detector 80 so that the detector receives radiation mainly of a wave length that is strongly absorbed by the gas whose concentration is to be determined. While this is sufficient to render IR sensor 70 operational, optionally, a second band pass optical filter 83 is also placed in the optical path of the radiation in front of a second detector to function as a reference signal for the IR sensor embodiments illustrated. The concentration, "C", of the gases to be sensed is then calculated on the basis of the response of the detector to the intensity of the transmitted beam. The greater the concentration of the absorbing species in the gas, the lower the intensity of the transmitted beam. The calculation is performed either by electronic circuits in detector chamber 74 or digitally through the microprocessor optionally contained in detector chamber 74. Electronic circuitry and relationship with the microprocessor is known to those skilled in the art. Reference can be had to one of the inventor's U.S. Pat. Nos. 4,578,762 or 4,694,173, hereby incorporated by reference, to illustrate a signal processing arrangement. Reference can also be had to U.S. Pat. No. 5,464,983 to Wang, also incorporated herein by reference for a signal processing arrangement.

Figure 7:
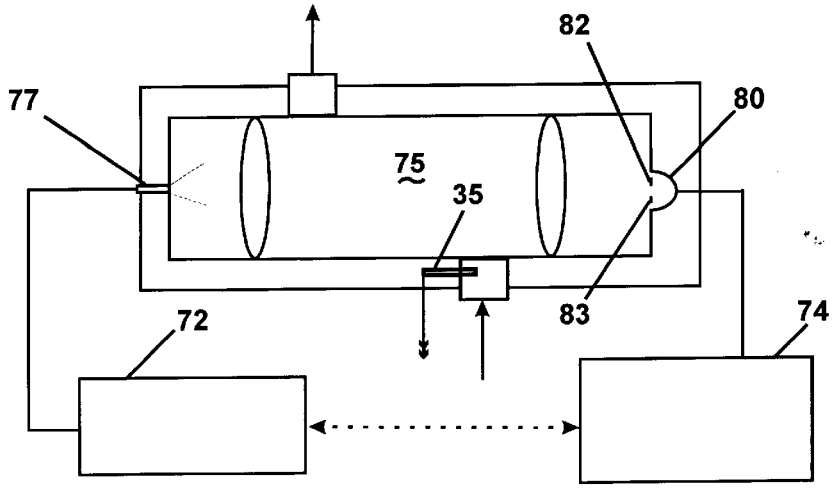

As indicated, IR sensor can take various configurations and placements in the system. As shown in FIG. 2, IR sensor 70 can be attached to outlet passage 44 of fuel vaporizer 34. Alternatively, IR sensor 70 can be placed in outlet line 30 of evaporator canister 25 or the outlet line of fuel vaporizer 34 as shown in FIG. 1 and in the expanded view in FIG. 4. The FIG. 4 embodiment is, in fact, the embodiment used in the data shown in the graph depicted in FIGS. 10, 14 and 15. Alternatively, to provide a sufficient beam length the IR sensor arrangement shown in FIG. 5 can be utilized. In the FIG. 5 arrangement, focusing optical lenses 79 are replaced by a reflective optic 85 doubling the beam length with the radiation source chamber 72 and the detector chamber 74 placed on the same side. Alternatively, a specially constructed gas sample chamber 75 as shown in FIG. 7 can be utilized. The FIG. 7 embodiment is, in fact, the embodiment used to generate the data shown in the graphs depicted in FIGS. 9, 11–13 and 16.

Figure 8:
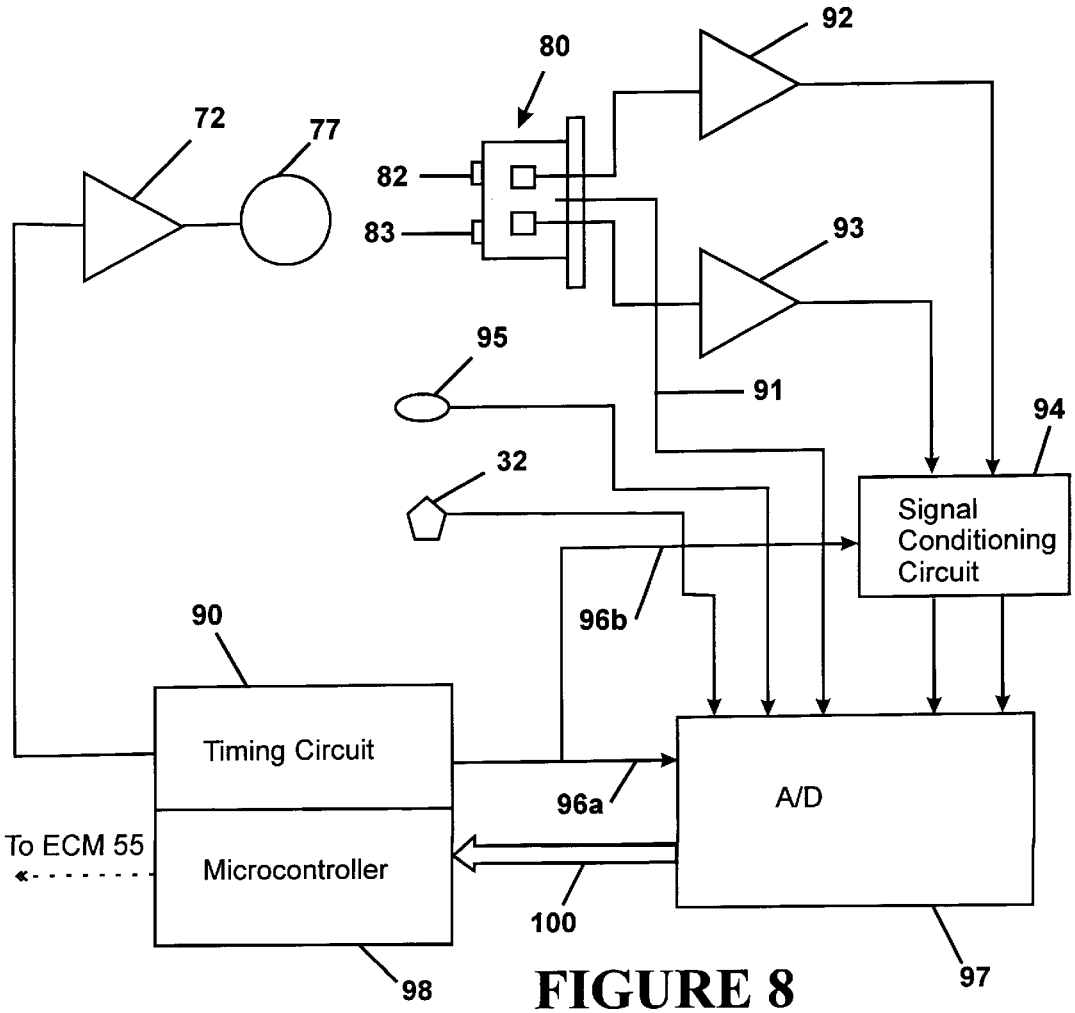
FIG. 8 is a schematic of the electronics employed in the IR hydrocarbon sensor.

FIG. 8 illustrates the basic electronic schematics utilized in IR sensor 70. The electrical power for the sensor electronics can be taken from or powered by the vehicle's electrical system. The source driver circuit 72 supplies electrical current to IR radiation source 77. The source driver circuit may be arranged as voltage output, current output or power output as well as a circuit with finite output impedance. Preferably, source driver generates a DC current which is switched on and off at a set frequency and duty cycle. The circuit may also operate in DC mode when no switching occurs and constant current is supplied to the IR radiation source. (In practice, signal noise considerations require pulsing or cycling the radiation source.) In the pulsed mode of operation the switching of the source current or voltage is controlled by a clock or timing circuit 90, the last may also be a part of embedded microcontroller hardware or implemented in the embedded software. The IR source driver circuit 72 and timing circuit 90 control the energy dissipated and emitted by the IR radiation source 77 so that the temperature of the gas stream in gas sample chamber 75 does not raise to the auto ignition temperature of the fuel vapor. See U.S. Pat. No. 5,608,219 to Aucremanne, issued Mar. 4, 1997, incorporated herein by reference. Signal conditioning part of the sensor electronics in the case of dual beam sensor implementation includes first and second amplifiers 92, 93 for amplifying the electrical signals coming from IR detector elements with HC and reference band pass optical filters 82, 83, respectively. The amplified signals are then further conditioned by the signal conditioning circuit 94, which may include, but not limited to filtering and synchronous demodulation. In a case of synchronous demodulation the signal conditioning circuit 94 receives the timing or chopping or synchronization signals from a synchronization circuit 90. The output signals of signal conditioning circuit is digitized in an analog-to-digital converter 97. The digital signal is then sent to an imbedded microcontroller 98. Also inputted to the analog-to-digital converter 97 are readings from pressure transducer 35 and readings of the pre-vaporized fuel temperature from a temperature sensor 95 and thermistor (detector) readings shown on line designated by reference numeral 91. (Temperature readings at detector 80, in contrast to temperature readings of the pre-vaporized fuel, are taken in on line 91. The system illustrated adjusts the detector signals by the temperature of the detector sensed by a thermistor in detector 80. Conceptually, the system could be designed to control detector 80 at a stabilized temperature. In this case the thermistor would be used in the detector temperature control loop, which could be implemented as a separate circuit or in the software. For any number of reasons, this is not preferred. It should also be recognized that a thermistor may not be needed if the accuracy or specific implementation of sensor 70 is sufficient without detector temperature control or correction. In practice, detector temperature is sensed and the IR sensor reading adjusted accordingly as shown for the preferred embodiment.) The pressure transducer readings, the temperature readings (pre-vaporized fuel and detector), and the conditioned detector readings allow microcontroller 98 to calculate an energy reading indicative of the hydrocarbon concentration in the fuel vapors passing through gas sample chamber 75 at that time in the form of a periodic energy signal outputted to ECM 55 as shown by arrowhead indicated by reference numeral 100. Importantly synchronization circuit 90 sets IR radiation pulses and the extraction of detector data vis-a-vis signal conditioning circuit 94 to coincide with one another. Further, by means of microcontroller 98 peripheral interface the setting of the light pulsing or frequency of the arrangement is controlled to give optimum IR sensor signals for the hydrocarbon concentration of the fuel vapors being sensed.

It should be additionally noted that the timing circuit signal on line designated by reference numeral **96*a* may be optionally implemented in place of the signal designated by reference numeral 96*b* when signal conditioning circuit does not include a synchronous demodulation circuit and demodulation is performed by A/D converter 97 with optional software. For example, a system with a pulsed source would preferably utilize the timing signal on line 96*a*. Other signal conditioning arrangements can be used whereby the demodulating circuit is removed with its function performed elsewhere as in A/D converter 97 or even digitally in microcontroller 98 so long as synchronization is achieved between source and detector. The signals are synchronized at a 1 to 1 ratio in that one light source pulse generates one detector signal. In the black body IR sensor of the preferred embodiment, the fueling signal generated by sensor 70 equals the frequency of the source pulse. In other embodiments of IR sensor 70, particularly solid state IR sensors pulsing at higher frequencies, a fueling signal to ECM 55 may be generated after factoring a number of detector signals. Conceivably, selected detector signals could be sampled. "Correlated" as used herein and in the claims means any and all techniques used in sampling the synchronized detector signals. Also, as noted, a two channel detector is illustrated. However, the reference channel is optional and only a single channel detector may be used because of cost consideration. Still further, several channels (more than two) may be employed which may, for example, be desired in engines not fueled by gasoline. Still further, it must also be noted that the inventive system, as shown for example in FIGS. 1, 2 and 4–6, is directly sensing a moving gas stream in a conduit passing to the engine's fueling system and there is no gas sampling system as typically used in the IR sensor art. This arrangement permits rapid measurements that are otherwise difficult or not possible to obtain in IR sensors employing gas chambers for collecting the gas. IR sensors constructed with conventional components used in the arrangement described with reference to FIG. 8** have produced discernible sensor signals despite the absence of the typical gas sampling system used by IR sensors.

The circuits, timing circuit, A/D, and signal conditioning circuit 70 discussed above are somewhat conventional and they can be readily constructed by one skilled in the art to perform the function indicated. For example, the signal conditioning circuit comprises band pass filter circuits, amplifiers and optionally a demodulator circuit which can be readily constructed by a technician. Microcontroller 98 can be programmed with known algorithms to produce the fueling signal.

Essentially microcontroller 98 will take the demodulated and filtered radiation signals from signal conditioning circuit 94, modify the signals to account for thermopile temperature noise sensed vis-a-vis signal 91 to determine the transmittance of the radiation (for example using double beam absorption principle) from which the concentration is further adjusted by mass flow readings from pressure transducer 32 and temperature readings from thermometer 95. The adjustments can be made from look-up tables stored in memory of microcontroller 98. Further calculations are then made from calibration data, also stored in memory, to normalize the signal by which a fueling signal, i.e., the A/F ratio or lambda of the pre-vaporized fuel stream is sent to ECM 55 for fueling control. All calculations are readily known and thus not described in detail. Further, the order in which the calculations are performed may be varied as can be appreciated by those skilled in the art.

Apart from the circuits, the IR components are conventional. For example detector 80 is a thermopile detector which is preferred. However, other detectors can be used to measure radiation such as bolometers, and pyroelectric detectors. Quantum detectors such as lead selenide, indium antimonide, indium aluminum phosphate photodiodes and other could also be employed. The infrared source 77 is preferably a black body radiator. However, IR LEDs may also be used. The optical filters are set at 3.91 microns for the reference channel narrow band pass filter 83 and 3.4 micron for hydrocarbon narrow band pass filter 82. Narrow band pass filter 82 is filtered within ranges of +/−0.1 microns and preferably +/−0.05 microns , i.e., 3.35–3.45 microns. Depending on the hydrocarbon molecular composition additional or different narrow band pass filters can be employed.

The preferred embodiment uses a black body source of radiation and a thermopile detector. It is possible by pulsing the black body source to keep the temperature of the combustible gas mixture below the auto-ignition temperature. This invention does not pulse the radiation source for that purpose. In fact, for safety concerns, the black body radiation source does not exceed the auto-ignition temperature of the combustible gas mixture. Pulsing IR detector 70 in the synchronized arrangement disclosed in FIG. 8 is to achieve discernible detector signals with sensitivity sufficient to detect the air/fuel ratio of the pre-vaporized fuel.

Varying the temperature of the gas-mixture vis-a-vis IR black body source 77 produces a signal change which is utilized in signal conditioning circuit to generate detector signals with minimal noise, at least in the sense of minimizing DC noise otherwise present in a "constant on" source of radiation. Much of the signal noise in the DC arrangement illustrated is generally constant. By modulating the signal and filtering the signal at frequencies of modulation, the signal noise ratio is improved. The modulation is achieved in the black body IR sensor by pulsing the light source to vary the temperature of the source passing through the sensor. Ideally, the temperature would modulate between a temperature slightly less than the auto-ignition temperature and a low ambient temperature. In practice, the temperature will cycle at the frequencies needed by ECM 55 to control fueling within the limits of the sensitivity of the detector. That is if the temperature change does not produce sufficient modulation in the detector signal to filter the noise, the period of the cycle has to be increased and/or the temperature of the source increased. Using conventional detectors and maintaining the temperature of the source during the "on" position of the duty cycle near the auto-ignition temperature (estimated because of difficulty in measurement at not greater than about 200° C.) a frequency of 2 Hz has been determined to produce a sufficient modulating signal to achieve adequate signal noise filtering producing discernible IR sensor signals. Significantly faster cycling times, i.e. 4 Hz, will require changes in the components. Cycling times in the frequencies up to 2 Hz may be achieved with conventional components. This is a suitable frequency range (1 to 2 Hz) for today's fueling control systems of an internal combustion engine.

Again, it is to be understood that the invention is not limited to the black body radiation source and thermopile detector discussed with reference to the preferred embodiment. Any conventional source of radiation and conventional detector may be used in the synchronization control illustrated in FIG. 8. Specifically contemplated as an alternative embodiment, especially suited for proposed and contemplated fueling systems in which ECM 55 processes fueling data at frequencies of 10 cycles/second or higher is the use of LEDs (or other solid state devices) as radiation source 77 and a quantum detector. LED radiation sources produce bright light without significantly affecting temperature of the gas mixture and can be pulsed at megacycles. However, the significant benefit of an LED/quantum detector IR sensor 70 is the ability of the synchronization control of FIG. 8 to significantly improve signal noise ratio when compared to the black body/thermopile IR detector, particularly at higher frequencies made possible by the LED/quantum detector arrangement (i.e., photons, not temperature, measurement) which allow band pass filtering techniques and the like to improve the signal to noise ratios. Significantly, the rate at which the IR signals are produced by the synchronization control of FIG. 8 can be ideally matched with the fueling period of ECM 55 to produce precise and responsive control of the fueling system.

Figure 9:
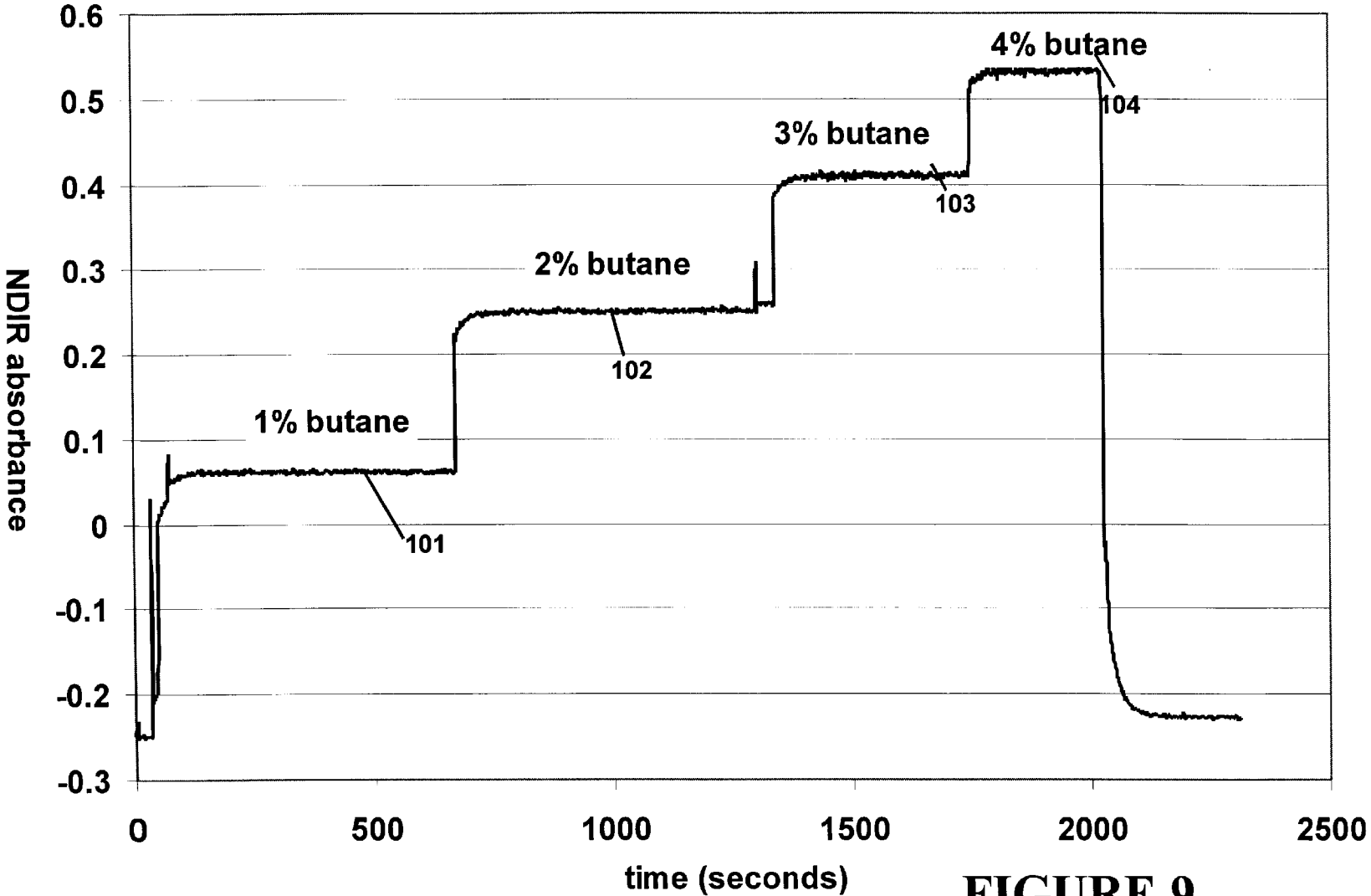
FIG. 9 is a plot of the sensor output for various hydrocarbon concentrations detected by the IR sensor.
Figure 14:
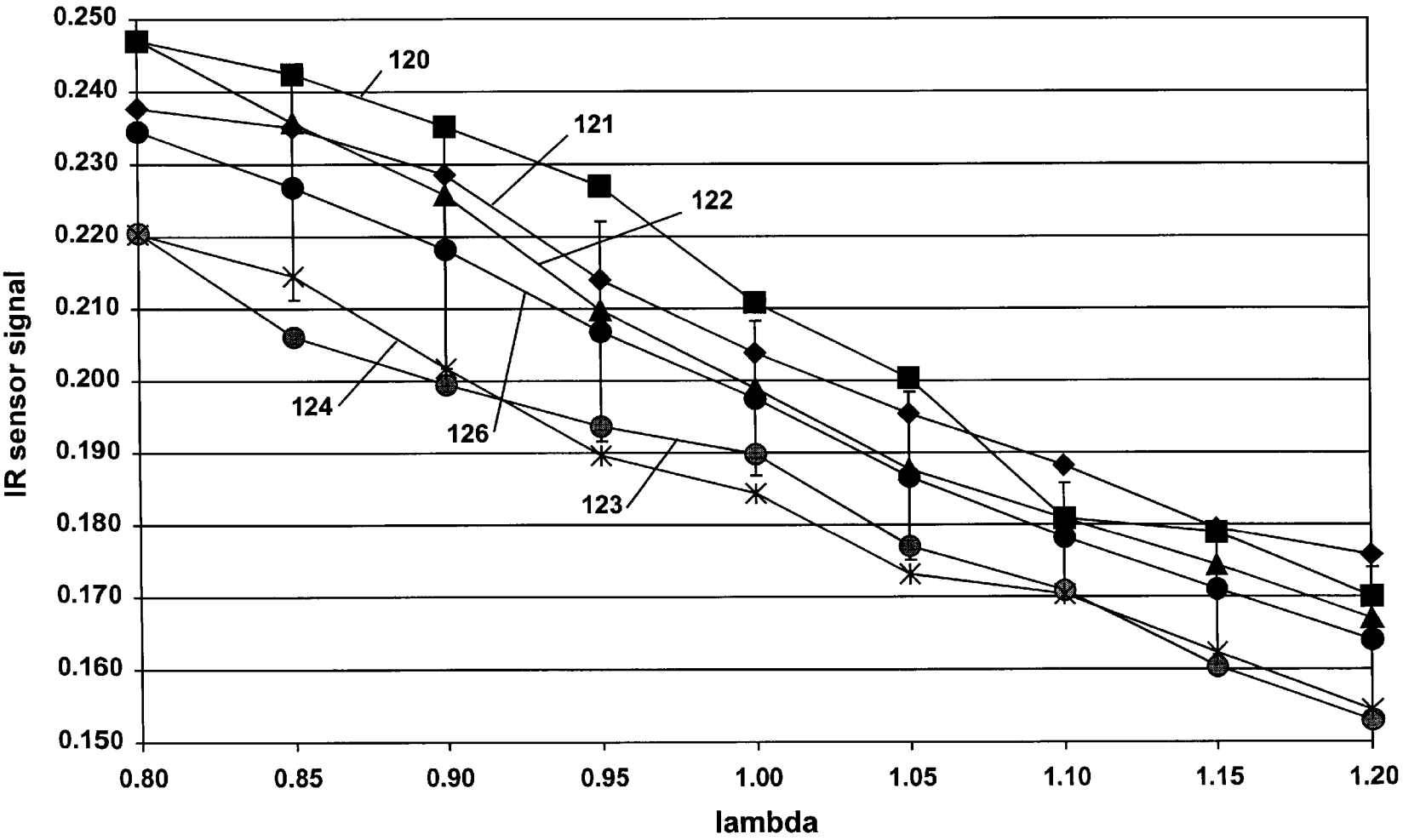
FIG. 14 is a plot of sensor signals for five gasolines having different aromatic contents and illustrates a method for calibrating the IR sensor for a lambda sensor application.
Figure 15:
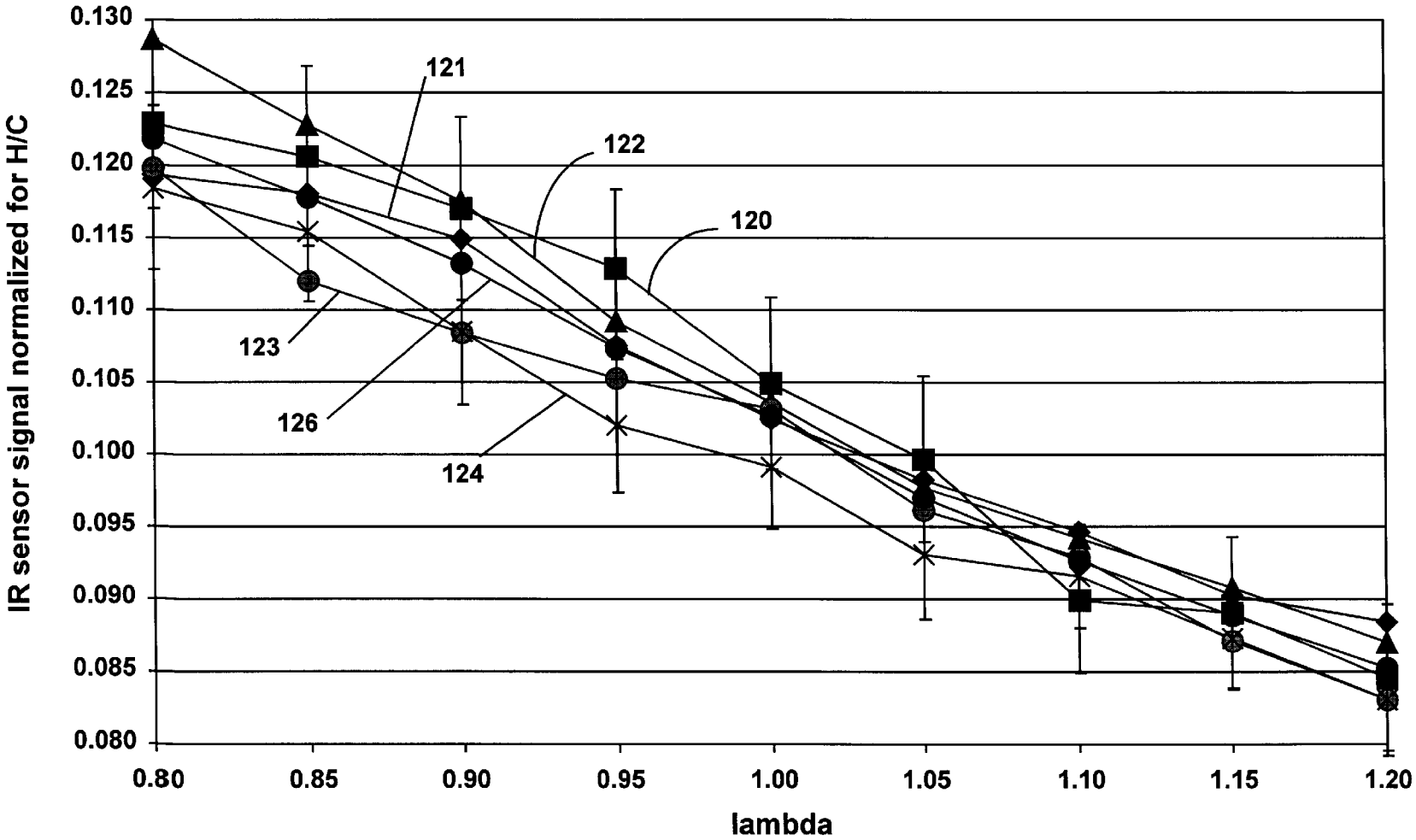
FIG. 15 is a plot of the sensor signals illustrated in FIG. 14 but normalized by the hydrogen to carbon atom ratio of the fuel; and, FIG. 16 is a plot of sensor readings for gasoline versus sensor readings for butane and illustrates a method for calibrating the IR sensor for the evaporative canister purge application.

Referring now to FIG. 9, there is shown a plot of IR hydrocarbon sensor 70 readings on the y-axis versus time in seconds on the x-axis for several different gases containing set hydrocarbon percentages of butane. The sensor readings for all the graphs discussed herein are plotted as absorption values and, pursuant to the discussion above, the absorbance is the negative logarithm of transmittance, T, at an absorption wavelength for hydrocarbon gases which is generally accepted as 3.4 microns, and a reference wavelength at 3.9 microns. In all results figures except FIGS. 14 and 15, the IR signal is the log of the ratio of the voltage in the reference channel (3.9 microns) divided by the voltage in the signal channel (3.4 microns). When the ratio of the reference channel signal to the analytical channel signal is between 0 and 1, the log of that ratio and hence the plotted IR sensor signal is negative. In FIGS. 14 and 15, the IR signal plotted is the difference between the log of this ratio with and without the hydrocarbon in the cell. Also, graph data in FIGS. 10, 14 and 15 were developed by a prototype IR sensor constructed along the line of the sensor shown in FIG. 4. All other graph data were developed by an embodiment depicted in FIG. 7.

Figure 10:
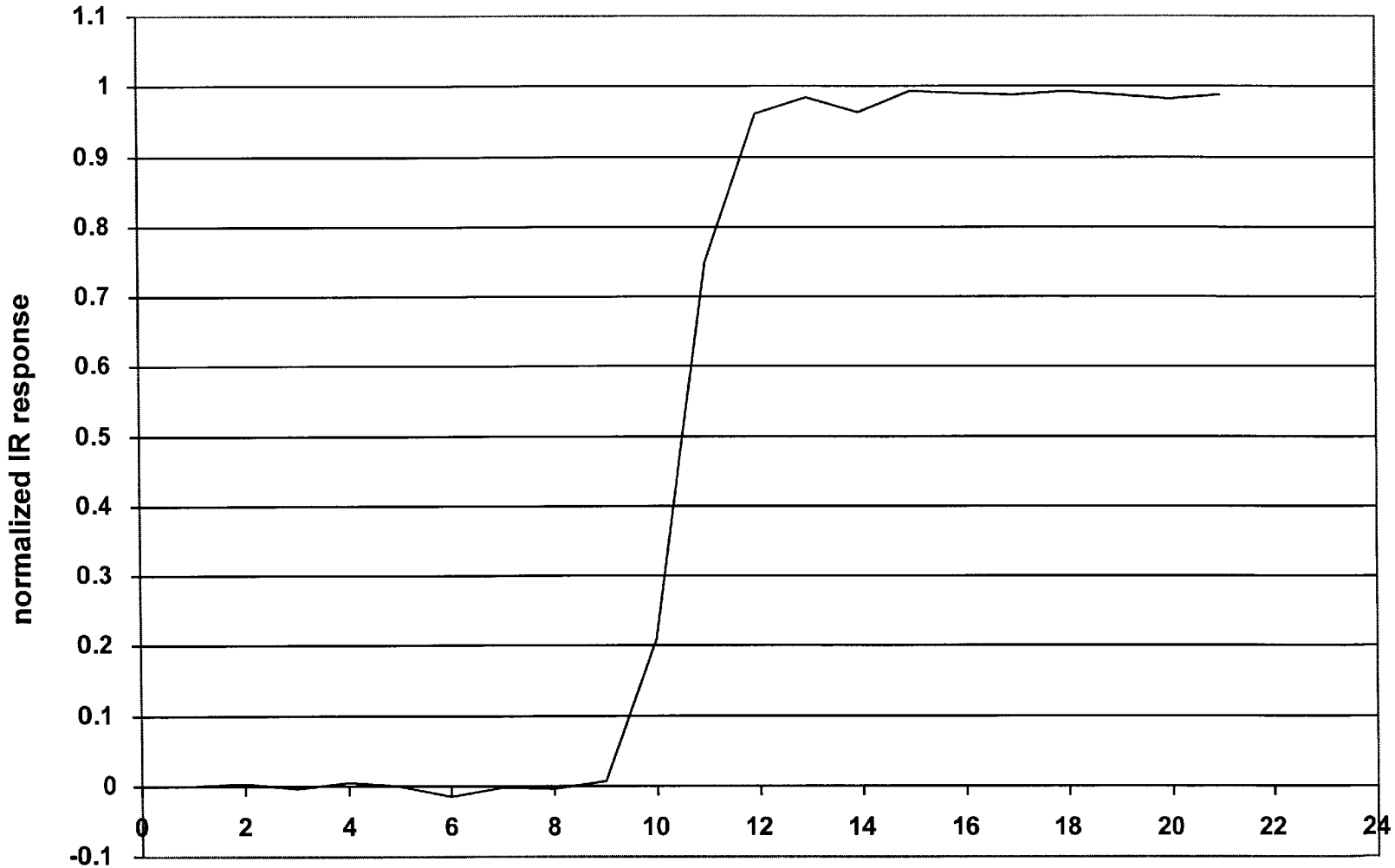
FIG. 10 is a plot of the sensor output for a single pulse of hydrocarbon.

A gas containing a concentration of 1% butane was passed through gas sample chamber 75 and developed consistent IR absorbance signals as indicated by the flat portion of the curve in FIG. 9 designated by reference numeral 101. The concentration of butane in the gas was increased to 2% and consistent IR absorbance signals were developed as shown by the flat portion of the curve designated by reference numeral 102. The butane concentrations were increased to 3% and 4% and similarly developed consistent signals as shown by reference numerals 103, 104, respectively. The plotted data was taken with light source 77 radiation temperature at 400° C. and a signal/noise ratio of 60 which translates to a relative error of about 1.5 to 2.0%. Similar results were obtained with light source 77 radiation temperature reduced to 200° C. While the time legend of the x-axis of FIG. 7 is rather long, the vertically-extending portions of the graph clearly show a fast response of the IR sensor 70 when the butane concentration was changed. In the tests conducted, light source 77 was pulsed at 2 Hz and the signal conditioning electronics was similarly synchronized to obtain readings at the source pulse frequency. The rapid time response of the sensor is shown in FIG. 10 using the cell gas chamber in FIG. 4, the data acquisition system in FIG. 8, and a gas stream containing 4.0% propane. The sensor reading shows a change of approximately 2 seconds to the step change in propane concentration. FIGS. 9 and 10 thus demonstrate that the IR sensor, constructed in accordance with the concepts discussed above, can i) clearly differentiate different concentrations of hydrocarbons and ii) respond in a timely manner to a change in the hydrocarbon concentration.

Figure 11:
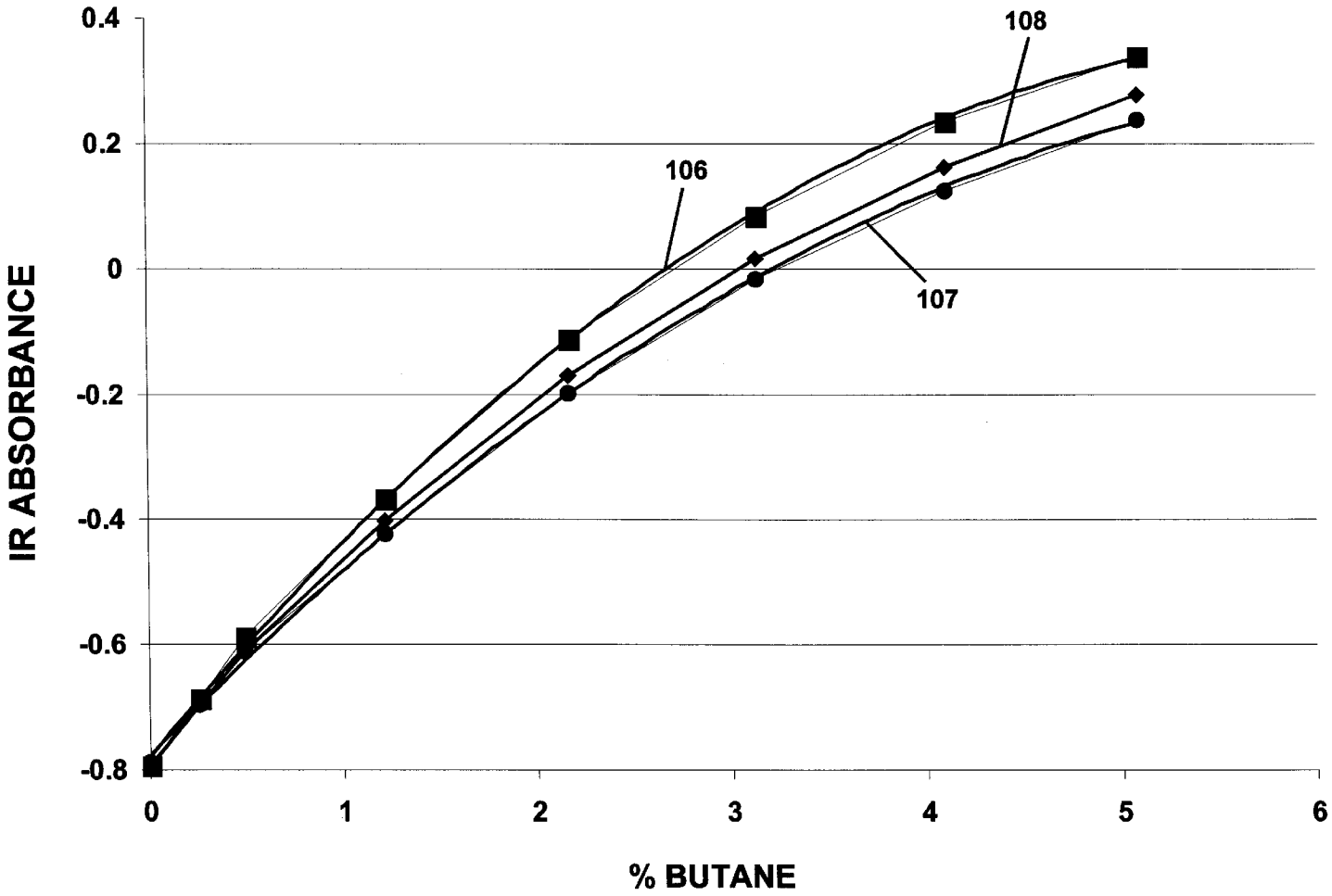
FIG. 11 is a plot of several traces of IR sensor readings taken at various hydrocarbon concentrations over different temperature ranges.

FIG. 11 contains several plots of sensor readings (y-axis) for different concentrations of butane (x-axis) which are at different temperatures. The absorbance readings are corrected for gas density to 25° C. according to the ideal gas law. The outermost curve passing through squares and designated by reference numeral 106 sensed gases and sensor detector at a temperature of 27° C. The innermost curve passing through circles and designated by reference numeral 107 sensed gases and sensor detector at a temperature of 68° C. A family of curves at a temperature gradient of 27° C. to 68° C. will exist between outermost curve 106 and innermost curve 107. For example, the curve passing through diamonds and designated by reference numeral 108 occurs with the gas and sensor detector at a temperature of 57° C. FIG. 11 clearly demonstrates that when IR sensor 70 is measuring hydrocarbons, there is a temperature relationship which exists independently of the hydrocarbon concentration in the gas due to the temperature dependent response of the detector and which can be corrected by algorithms in the signal processing arrangement of microcontroller 98. It is contemplated that existing vehicle temperature sensor readings will be inputted to microcontroller 98 and the IR sensor readings adjusted by known algorithms, extrapolated from the family of temperature curves demonstrated in FIG. 11.

Figure 12:
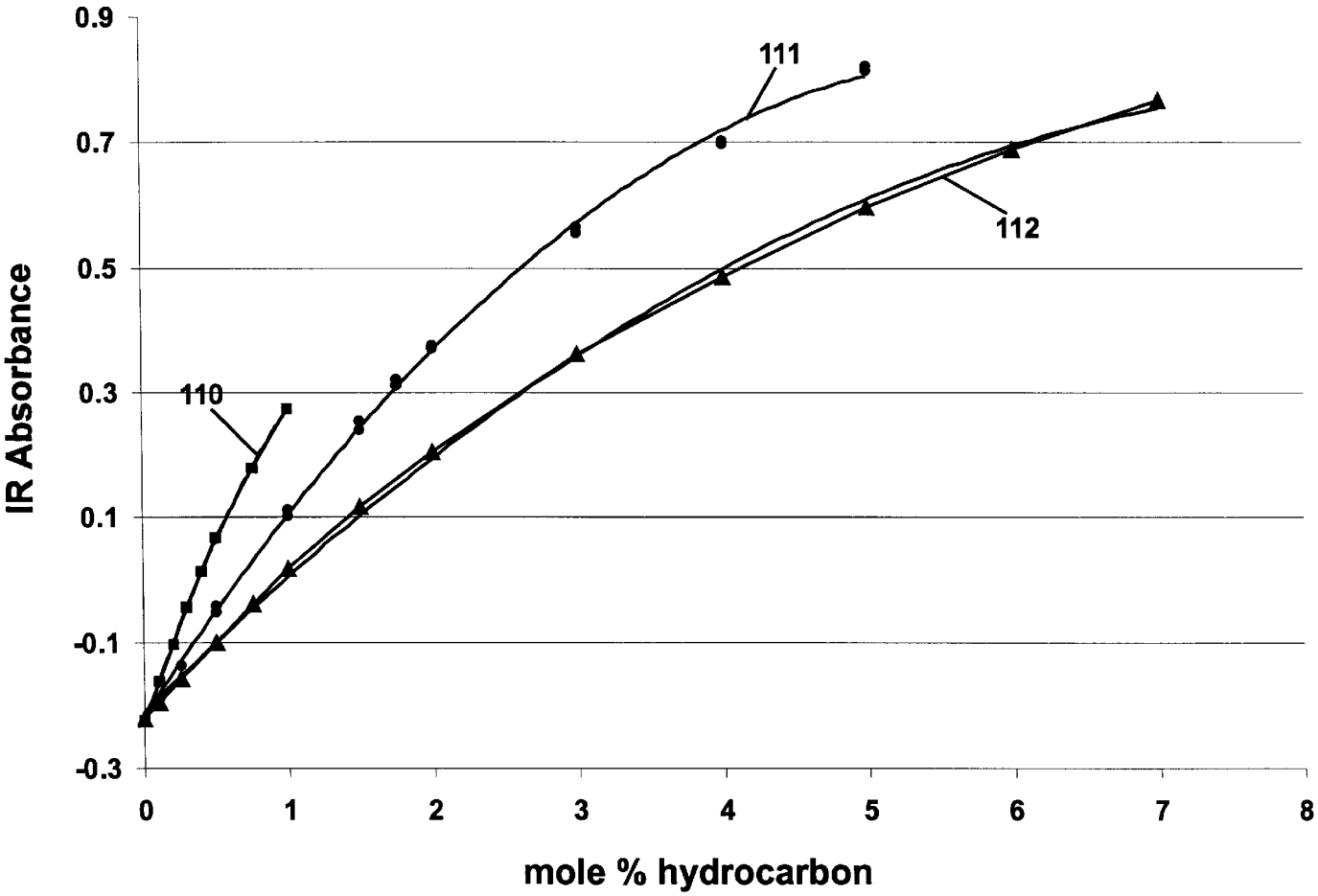
FIGS. 12 and 13 are graphs of several traces of sensor readings taken at different hydrocarbon concentrations for various fuel species vapors.
Figure 13:
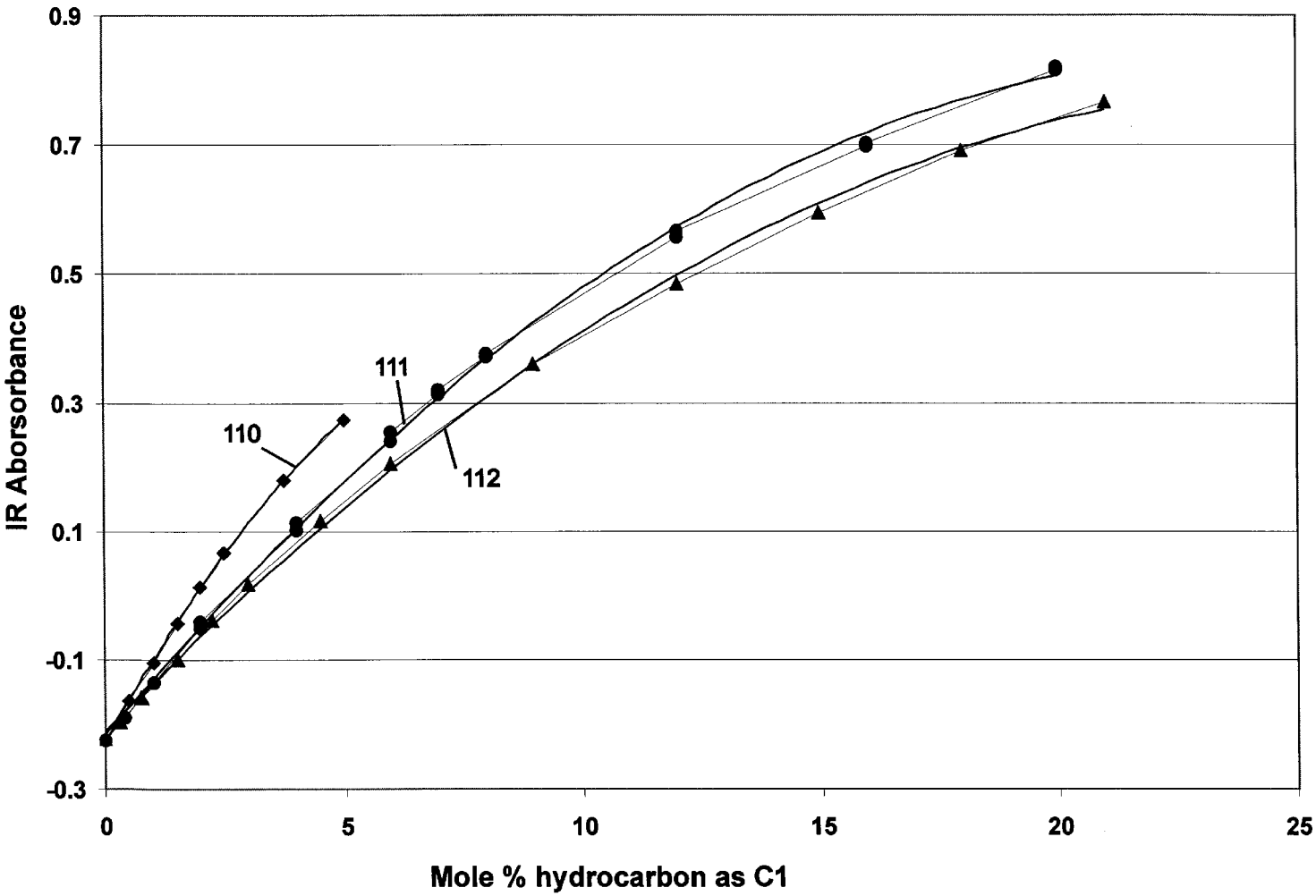

Referring now to FIG. 12, there are several curves of different types of hydrocarbons plotted for the IR sensor 70 signal (y-axis) obtained at various concentrations of hydrocarbons expressed as the mole percentage of the hydrocarbons present in the gas mixture (x-axis). The curve passing through diamonds and designated by reference numeral 110 is pentane. The curve passing through circles and designated by reference numeral 111 is butane and the curve passing through triangles and designated by reference numeral 112 is propane. As expected, the different hydrocarbon molecular strings have different absorption characteristics which correspond to different numbers of carbon atoms in each of these aliphatic hydrocarbons. As shown in FIG. 13, the three curves depicted in FIG. 12 designated by the same reference numerals used in FIG. 12 can be brought closer together so that the IR response is less species specific if the IR signal is normalized for the number of adsorbing groups in the molecule, i.e., carbon is C1. However, the curves are not coincident, thus illustrating that even aliphatic hydrocarbons of different carbon chain lengths will have different response factors per carbon atom. This is expected to be much more the case with unsaturated hydrocarbons such as olefins and aromatics, which comprise a large fraction of the components in gasoline and lend to the gasoline higher octane ratings. It is expected that the unsaturated hydrocarbons will have lower IR response factors than the aliphatic hydrocarbons.

Therefore, in order to function as an air to fuel ratio sensor to control the fueling of an engine, the IR sensor needs to demonstrate an average response for gasolines with different octane ratings and compositions that will permit control of the vaporizer used to generate the gasoline vapors to fuel the engine during cold-start. In FIG. 14, the response of the sensor to vaporized gasolines of different aromatic contents is shown. The gasoline vapor content of sample gas is plotted as lambda, where lambda is the air to fuel ratio of the sample relative to the stoichiometric air to fuel ratio. In this example, nitrogen gas was used in place of air. Set forth below in tabular form are the different gasoline grades for which curves shown in FIG. 14 are plotted.

| Gasoline Composition | Curve Passing Through | Reference Numeral |
|---|---|---|
| 89 Octane (19% aromatic) | Square | 120 |
| 89 Octane (42% aromatic) | Diamond | 121 |
| 93 Octane (24% aromatic) | Triangle | 122 |
| 93 Octane (35% aromatic) | Circle (light) | 123 |
| 93 Octane (40% aromatic) | Star | 124 |
| Average | Circle (dark) | 126 |

For each gasoline type, the IR sensor response decreases as lambda increases, corresponding to a decrease in the gasoline vapor concentration. Each gasoline has a slightly different IR response curve vs. lambda. However, the average response for all the gasolines is within +/−0.1 lambda unit for a given IR sensor response. This result is unexpected given the wide range of aromatic contents of the gasoline samples shown in this example. Thus, the engine fueling for the cold-start application can be controlled to within +/−0.1 lambda unit with this IR sensor.

Reference should now be had to FIG. 15 which is similar to FIG. 14 and contains lambda plots for the same gasolines shown in FIG. 14 which are likewise designated by the same reference numerals used in FIG. 14. However, the IR sensor signal has been normalized by the hydrogen to carbon ratio of the fuel. The "spread" between the plots has noticeably narrowed in FIG. 15. In fact, the response for any gasoline is within +/−0.05 lambda units for the average IR sensor response of all the gasolines. For example, the average sensor reading at 0.9 lambda (about 0.113 for graph 126) corresponds to a lambda of about 0.85 for graph 123 and 0.95 lambda for graph 120. Further, the "spread" between the different gasoline grades is considerably narrowed for lean operating conditions of the engine. The data by which microcontroller 97 normalizes the signal from IR sensor 70 is obtained from fueling signals processed by ECM 55 when the engine is operated at stoichiometric or at any fixed air/fuel ratio. As is known EGO sensor 64 (specifically a HEGO or even UEGO sensor) determines when engine 10 is at stoichiometric. Sensors on engine 10 give specific fuel and air flow readings which slightly vary depending on hydrocarbon content of gasoline grade since the stoichiometric fuel/air ratio changes for different gasoline grades. Those readings allow extrapolation of the hydrogen to carbon ratios in the fuel. In a cold-start application, the H/C ratio previously obtained when the vehicle was operated is used to normalize the readings of IR sensor 70.

Figure 16:
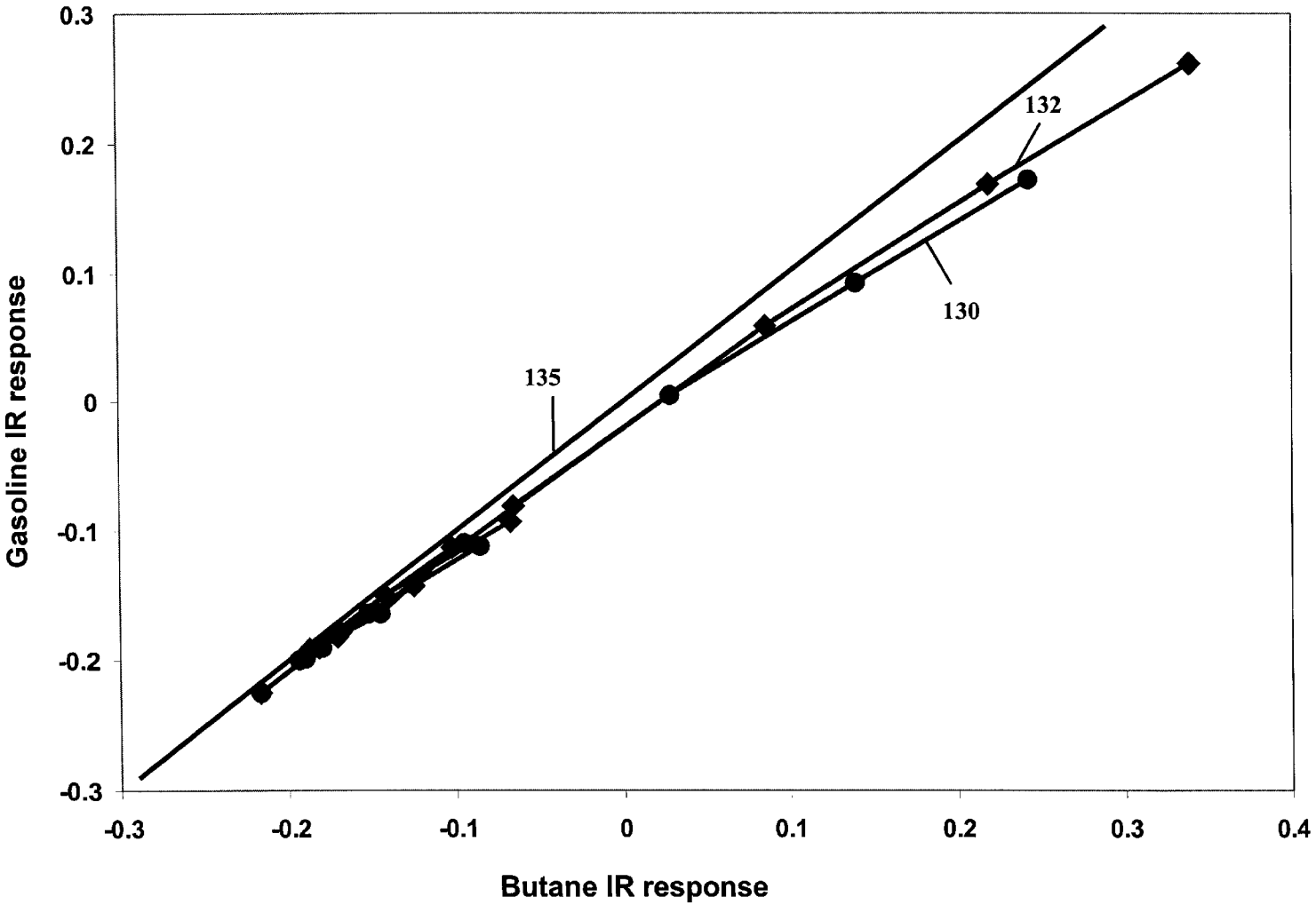

It is also desirable that the IR sensor be capable of measuring the vapor from a evaporative hydrocarbon canister without regard to the composition of the gasoline in the fuel tank. Referring next to FIG. 16, there is shown two plots of IR sensor signals (y-axis)for various concentrations of hydrocarbons expressed as equivalent mole percentage of butane (x-axis) for two different gasolines. The gasoline vapor was generated by bubbling an inert gas through the liquid hydrocarbon, thus simulating the purging of a evaporative hydrocarbon canister 25 in FIG. 1. More particularly, the hydrocarbon concentration after being sensed by IR sensor 70 was then compared to the response of the IR sensor for butane. The graph passing through circles and designated by reference numeral 130 was a synthetic gasoline with 20% aromatic composition and the graph passing through diamonds and designated by reference numeral 132 was synthetic gasoline with 35% aromatic composition. FIG. 10 clearly demonstrates that variations in aromatic content of gasoline fuels will not adversely affect IR sensor 70. As a point of reference, if the IR sensor reading for gasoline was identical to the IR sensor reading for butane, traces 130 and 132 would be coincident with straight reference line 135. Both gasolines approximate reference line 135 thus indicating that fixed concentrations of butane can be used to calibrate IR sensor 70. Generally, FIG. 16 demonstrates that IR hydrocarbon sensor 70 can be calibrated by the sensor response to an aliphatic hydrocarbon, i.e., butane in this particular example.

The invention has been described with reference to a preferred and alternative embodiments. Those skilled in the art upon reading and understanding the Detailed Description of the invention will recognize that modifications and alterations can be made to the invention. For example, those skilled in the art will recognize that one of the underpinnings of this invention is the recognition that pre-vaporized fuel systems represents the best choice to meet future emission control regulations if vehicles are to be powered by internal combustion engines. However, emission control can only be achieved if the energy of the pre-vaporized fuel can be determined in a manner usable by fueling control systems. Another underpinning of the invention is the recognition that the absorption measurements of an IR sensor can function as a hydrocarbon sensor if the IR sensor can be modified to function in a fuel control system environment. The data presented herein demonstrate that pulsed IR radiation source maintains the radiation temperature imparted to the combustible gases below their lower explosive limit while the optics provide sufficient signal strength relative to noise to detect gas composition. Significantly this occurs at unimpeded gas flow rates pass the detector which has a frequency response not less than 0.5 Hz rendering the instrument suitable for fueling control systems. For example, conventional fueling systems can change the injector's pulse width 3 times/second. The IR hydrocarbon sensor of the present invention can function in such systems. Accordingly, those skilled in the art will understanding that the fueling system is actually not, per se, part of the invention and will readily recognize any number of pre-vaporized fueling concepts are made possible once air to fuel ratio or hydrocarbon concentration of the fuel vapor-air mixture can be accurately determined in a fast manner. By way of example, conventional canister vapor systems and conventional pre-vaporized fueling systems, useful in cold-start applications, have been generally discussed. However, the invention is not limited to those systems. For example, fuel vapors can be generated by plasma treatments and the vehicle can be operated solely by pre-vaporized fuel. Further, fuel cracking, e.g. diesel fuel, can be controlled as determined by the IR hydrocarbon sensor to produce desired hydrocarbon molecules and fuel additives can be separately added to the fuel vaporizer to produce certain hydrocarbons having desired emission characteristics. Of course a specific underpinning of the invention as demonstrated throughout the Detailed Description is the recognition that one wavelength signal can generate meaningful fuel control information for all standard grades of detergent gasoline. Further, it is possible to acquire that signal without a reference channel. Further, it may be possible to utilize only one wavelength channel for different types of fuel. However, the invention in its broader fueling control scope is not necessarily limited to one wavelength detector in the IR sensor or even one wavelength detector for detergent grade gasolines and in its broader sense, may encompass multiple wavelength detectors in IR sensors. While testing has not demonstrated a need for an IR sensor with multiple detector channels in the evaporative recovery system of a gasoline powered engine, it is conceptually recognized that multiple wavelength detectors permit specific hydrocarbon differentiation that may conceivably have application for certain fuels and/or engine operating phases and to that extent, the invention contemplates use of multiple detector channel IR sensors. Finally, the invention, as discussed above, is not limited to gasoline and covers hydrocarbon fuels other than gasoline, i.e., gaseous fuels such as propane and methane, and mixtures of ethanol-gasoline or MTBE gasoline. It is intended to include all such modifications and alterations insofar as they come within the scope of the present invention.

Having thus defined the invention, it is claimed:

1. In a vehicle having an internal combustion engine and equipped with a fuel vapor system which uses vapors from a fuel with air supplied said engine as a pre-vaporized fuel to at least partially assist in fueling said engine, the improvement comprising:

a) an infrared hydrocarbon sensor for sensing a first air to fuel ratio or a hydrocarbon concentration of said pre-vaporized fuel, said infrared sensor including means for preventing generation of an infrared radiation beam by said infrared sensor at temperatures greater than an auto-ignition temperature of said pre-vaporized fuel; and, b) an engine control for controlling a second air to fuel ratio of air and said fuel supplied said engine based on said sensed hydrocarbon concentration or said first air to fuel ratio of said pre-vaporized fuel.

2. The improvement of claim 1 wherein said fuel vapor system includes at least one or both items of a group consisting of i) a fuel pre-vaporizer and ii) at least one evaporative canister for storing fuel vapors.

3. In a vehicle having an internal combustion engine and equipped with a fuel vapor system which uses vapors from a fuel with air supplied said engine as a pre-vaporized fuel to at least partially assist in fueling said engine, the improvement comprising:

a) an infrared hydrocarbon sensor for sensing a first air to fuel ratio or a hydrocarbon concentration of said pre-vaporized fuel;

b) an engine control for controlling a second air to fuel ratio supplied said engine based on said hydrocarbon concentration of said pre-vaporized fuel or said first air to fuel ratio of said pre-vaporized fuel;

c) said fuel vapor system including at least one or both items of a group consisting of i) a fuel pre-vaporizer and ii) at least one evaporative canister for storing said vapors; and, said infrared sensor having a pulsed radiation source generating infrared radiation beams at temperatures not greater than an auto-ignition temperature of said vapors and oxygen passing through said infrared radiation beams.

4. The improvement of claim 3 wherein said pulsed radiation source generates radiation beams at set frequencies and through which said pre-vaporized fuel passes said infrared sensor has a detector generating an analog signal and a signal conditioning and acquisition circuit sampling said analog signal at frequencies correlated to frequencies of said pulsed radiation source to produce a plurality of detector sensor signals, each detector sensor signal indicative of hydrocarbon concentration of said pre-vaporized fuel.

5. The improvement of claim 4 wherein said set frequency is not less than about 1 Hz.

6. The improvement of claim 4 wherein said infrared sensor detector includes a first detector and a second detector, each with narrow bandpass filters, said first detector detecting wavelengths of radiation spectra passing through the said pre-vaporized fuel with no or little absorption and said second detector absorbing radiation spectra of a set radiation spectra and detecting wavelengths of not absorbed radiation spectra passing through said pre-vaporized fuel.

7. The improvement of claim 4 wherein said detector is a thermopile.

8. The improvement of claim 7 wherein said source is a black body radiation source.

9. The improvement of claim 4 wherein said source is an LED and said detector is a quantum detector.

10. The improvement of claim 4 further including a pressure sensor for measuring the pressure of said pre-vaporized fuel; a temperature sensor for measuring the temperature of said pre-vaporized fuel and a controller for adjusting the detector signal by information recorded from said pressure and temperature sensors.

11. The improvement of claim 10 further including a timing circuit controlling the pulsing of said source and causing said signal conditioning and acquisition circuit to obtain said detector signals at frequencies correlated to frequencies at which said source is pulsed.

12. The improvement of claim 11 wherein said source includes a D.C. power source, said signal conditioning and acquisition circuit includes a band pass filter, an amplifier and a demodulating circuit receiving a signal from said timing circuit for demodulating said detector signals at said set frequencies of said source.

13. A control system for use in regulating the fueling of an internal combustion engine having a source of pre-vaporized fuel for use as the sole or partial source of fuel for said engine; said control system comprising:

a) a pressure sensor for sensing the pressure of a stream of pre-vaporized fuel admitted to the combustion chambers of said engine;

b) a temperature sensor for sensing the temperature of the pre-vaporized fuel admitted to the combustion chamber of said engine; and, c) an IR sensor in a conduit through which said pre-vaporized fuel passes substantially unimpeded; said sensor having a source of radiation passing through said stream of pre-vaporized fuel on a side of said conduit, at least one detector on a side of said conduit for detecting the radiation of said source after said radiation has passed through said stream, a signal conditioning circuit for extracting from said detector a plurality of absorption signals at set frequencies, and a controller for adjusting said detector signals by the temperature and pressure sensor signals and by a calibration setting whereby the concentration of hydrocarbons in said pre-vaporized fuel is determined.

14. The system of claim 13 wherein said detector is a dual channel detector.

15. The system of claim 14 wherein said source of radiation is a solid state device and said detector is a quantum detector.

16. The system of claim 14 wherein said source of radiation is a black body and said detector is a temperature detector.

17. A method for using pre-vaporized fuel in the fueling system of an internal combustion engine comprising the steps of a) providing a source for generating or collecting a gas mixture stream having a concentration of pre-vaporized fuel inputted as fuel to said engine;

b) passing said stream by a pulsing source of infrared radiation;

c) detecting optically filtered radiation transmitted through said stream by said radiation source;

d) determining from said detected radiation the hydrocarbon concentration of said gas mixture; and, e) adjusting the operation of said engine in response to the detected hydrocarbon concentration of said stream.

18. The method of claim 17 wherein said infrared source of radiation is operated at frequencies sufficient to prevent the temperature of said stream from reaching its auto ignition temperature.

19. The method of claim 18 wherein said step of detecting said radiation is synchronized with said pulsing step whereby a plurality of radiation signals are generated over time.

20. The method of claim 19 wherein said source of generating said gas stream is controlled by the hydrocarbon concentration in said determining step.

21. The method of claim 19 wherein said gas source is an evaporative fuel canister and the gas from the evaporator system is directly sampled.

22. The method of claim 21 wherein said fuel is any conventional detergent grade gasoline, said detector measuring radiation at a single radiation wavelength of about 3.4 microns whereby hydrocarbon signals for any detergent grade gasoline are generated by one detected radiation wavelength.

23. The method of claim 22 wherein said radiation is filtered at said 3.4 micron wavelengths within a range of +/−0.1 microns and compared to a reference wavelength to determine said detected radiation.

24. The method of claim 23 wherein said detector is calibrated with butane.

25. The method of claim 19 wherein said gas source is a fuel vaporizer and the gas is directly sampled from said fuel vaporizer.

26. The method of claim 19 further including in said determining step the step of normalizing each of said radiation signals by the hydrogen to carbon ratio present in the hydrocarbons of the pre-vaporized fuel whereby lambda control of said engine is possible.

27. The method of claim 26 wherein said engine is gasoline powered and said method further includes the initial step of calibrating said sensor by exposing said sensor to gases having known concentrations of a single species of an aliphatic hydrocarbon gas whereby said sensor is capable of detecting concentrations of different standard grades of gasoline.

28. The method of claim 27 wherein said single species of hydrocarbon is butane.

* * * * *